US006000260A

United States Patent [19]

Price et al.

[11] Patent Number: 6,000,260

[45] Date of Patent: Dec. 14, 1999

[54] SPIRAL DUCT OVALIZER

[75] Inventors: Miller S. Price, 1081 St. Ives, Morristown, Tenn. 37814; Gregory C. Moyers, Arden, N.C.; Daniel R. Whitehead, Morristown, Tenn.; Mark A. Froning, Arden, N.C.

[73] Assignee: Miller S. Price, Morristown, Tenn.

[21] Appl. No.: 09/055,676

[22] Filed: Apr. 6, 1998

[51] Int. Cl.[6] ..... B21C 37/15

[52] U.S. Cl. ..... 72/17.2; 72/392

[58] Field of Search ..... 72/17.2, 392, 453.02, 72/453.06, 453.08; 100/46

[56] References Cited

U.S. PATENT DOCUMENTS

| | | | |
|---|---|---|---|
| 38,616 | 5/1863 | Whitlock et al. . | |
| 62,852 | 3/1867 | Jennings . | |
| 2,568,730 | 9/1951 | Guthmann . | |
| 2,895,527 | 7/1959 | Powell et al. . | |
| 3,043,361 | 7/1962 | Kelso . | |
| 3,710,609 | 1/1973 | Jones . | |
| 3,747,394 | 7/1973 | Cunningham . | |
| 3,961,516 | 6/1976 | Priester . | |
| 3,996,783 | 12/1976 | Meserole . | |
| 4,031,731 | 6/1977 | Richardson | 72/14.8 |
| 4,567,742 | 2/1986 | Castricum . | |
| 4,571,980 | 2/1986 | Goodwin . | |
| 4,590,785 | 5/1986 | Morris . | |
| 4,706,481 | 11/1987 | Castricum . | |
| 4,711,110 | 12/1987 | Castricum . | |
| 4,803,881 | 2/1989 | Dudley | 72/392 |
| 4,828,474 | 5/1989 | Ballantyne | 100/46 |
| 4,862,724 | 9/1989 | Haws . | |
| 4,914,939 | 4/1990 | Brinegar . | |
| 4,930,331 | 6/1990 | Manning . | |

FOREIGN PATENT DOCUMENTS

| | | |
|---|---|---|
| 23 63 629 | 6/1975 | Germany . |
| 407 926 | 9/1966 | Switzerland . |

OTHER PUBLICATIONS

International Search Report mailed Jul. 15, 1999 in PCT/US 99/06229.

Product Brochure, "The Helix–Ovalizer 36/12," Spiral–Helix, Inc., Buffalo Grove, Illinois.

Three photographs of "Ovalator" machine, believed to correspond to Goodwin U.S. Pat. No. 4,571,890.

Product Brochure, "The Compact Helix Ovalizer 24/6," Spiral–Helix, Inc., Buffalo Grove, Illinois.

*Primary Examiner*—Lowell A. Larson

*Attorney, Agent, or Firm*—Carter & Schnedler, P.A.

[57] ABSTRACT

An ovalizer which employs hydraulic cylinders to directly actuate duct forming members for forming round spiral duct to oval. The ovalizer includes a pair of elongated and laterally spaced-apart duct forming members sized to fit within a ductwork section and to bear against opposing interior surfaces of the ductwork section. Spaced longitudinally along and between the duct forming members are a plurality, five in the disclosed embodiment, of double-acting hydraulic cylinder assemblies for selectively forcing the duct forming members apart for forming round duct to oval, and retracting the duct forming members towards each other at the conclusion of a forming operation. A feedback control system ensures that the hydraulic cylinder assemblies extend together at approximately the same rate and stop when a predetermined extended position is reached. The ovalizer includes a plurality of signal-controlled valves, each of which is connected for controlling the application of hydraulic fluid under pressure to a corresponding one of the hydraulic cylinder assemblies for selectively causing the corresponding hydraulic cylinder assembly to extend and to retract. The feedback control system includes a plurality of position transducers connected to corresponding ones of the hydraulic cylinder assemblies. Position signals output by the transducers indicate the positions of the hydraulic cylinder assemblies. A programmed controller receives the individual position signals, and is connected to the valves for individually controlling the valves.

34 Claims, 16 Drawing Sheets

SPIRAL DUCT OVALIZER

BACKGROUND OF THE INVENTION

The present invention relates generally to thin-walled spiral duct commonly employed in air conditioning and heating installations, and more particularly, to apparatus for forming round spiral ductwork to oval.

Round, thin-walled spiral seamed metal ducts made from strips of sheet metal are widely employed in heating and air conditioning installations, as well as in other air ducting installations. Such spiral duct is efficiently produced in desired lengths by Tubeformer machines, manufactured for example by Spiral-Helix, Inc. of Buffalo Grove, Ill., and described for example in Castricum U.S. Pat. Nos. 4,567,742; 4,706,481 and 4,711,110. Spiral duct has a number of advantages, in both ease of installation and performance.

There are however installations where limited space prevents the use of round spiral duct, and where, accordingly, flatter ductwork which is rectangular or oval in cross-section is employed. (Oval ductwork is also known in the art as "flat-oval," and the terms "oval" and "flat-oval" are employed interchangeably in the context of the invention.) As the Tubeformer machines produce round and not oval ductwork, a separate machine, known as an ovalizer, is ordinarily employed to form round ductwork to oval.

Very briefly, a typical ovalizer includes a pair of elongated and laterally spaced-apart duct forming members that are sized to fit within a ductwork section and to bear against opposing interior surfaces thereof. The duct forming members are forced apart in some manner to form the round ductwork to oval, slightly stretching the metal, perhaps by one percent, so that the formed oval shape is maintained. Extreme force is required, approximately 34,000 pounds per lineal foot, or approximately 340,000 pounds total force to form a section of ductwork ten feet in length.

One general type of ovalizer which has been proposed employs a plurality of pivoting mechanical linkage or toggle arms spaced longitudinally along the duct forming members and connected to an intermediate actuator rod driven in a longitudinal direction by an hydraulic cylinder. The duct forming members are forced apart as the actuator rod moves longitudinally with reference to the duct forming members. Longitudinal motion of the actuator rod is thus mechanically translated to motion at a right angles as the duct forming members move apart relative to each other.

An inherent beneficial result of this mechanical arrangement, subject to manufacturing tolerances, and subject to bending of the duct forming members, is that the duct forming members move apart in a parallel manner, which is assured by the geometry of the linkage mechanism and actuator rod. In other words, all points along each of the duct forming members inherently move together the same distance. Examples are disclosed in Jones U.S. Pat. No. 3,713,609 and Meserole U.S. Pat. No. 3,996,783. Related mechanisms, for slightly different purposes, are disclosed in Cunningham U.S. Pat. No. 3,747,394 and Haws U.S. Pat. No. 4,862,724.

Such arrangements using mechanical linkage or toggle arms and a longitudinally driven rod for right angle motion translation have several drawbacks. One drawback is that the available force is not constant over the range of motion, since the mechanical advantage increases as the duct forming members move farther apart. Thus, when smaller ductwork sizes are formed from round to oval, relatively less force is available for stretching the metal, compared to when larger ductwork sizes are formed from round to oval and the duct forming members correspondingly are farther apart. Another disadvantage is that the physical size of the linkage arms required to bear the force can limit the range of motion.

A related functional principle is employed in ovalizers manufactured by Spiral-Helix, Inc. such as the commercially available Spiral-Helix, Inc. models known as "The Helix Ovalizer 36/12" and "The Compact Helix Ovalizer 24/6." It is believed that those two machines employ an inclined plane mechanism wherein one of the duct forming members includes a series of inclined plane surfaces, in the form of hardened steel wedges. Corresponding inclined plane surfaces are provided on a actuator rod which is positioned between the two duct forming members and which is driven longitudinally by a hydraulic cylinder. Thus, as the actuator rod and its inclined planes move relative to the duct forming members, which are restrained against longitudinal movement, sliding motion of the inclined plane surfaces against one another forces the duct forming members apart. Again, the mechanism effects right angle motion translation. The stroke of the Spiral-Helix, Inc. ovalizer is six inches.

"The Compact Helix Ovalizer 24/6" and "The Helix Ovalizer 36/12" are equipped with sets of semi-cylindrical heads of different diameters corresponding to the minor axis of different sizes of oval ductwork after forming, as well as a set of spacers that can be selectively installed as required.

Despite the apparently simple principle of the ovalizers manufactured by Spiral-Helix, Inc., the practical implementation is difficult. Relatively high pressure is applied to wearing parts, which accordingly must be maintained. Moreover, as the duct forming members move farther apart, there is less contact area available between the corresponding inclined plane surfaces. Thus, as the duct forming members move apart to the point where the duct metal begins to stretch, less contact area is available, concentrating increasing pressure on decreasing areas of the inclined plane surfaces.

As a result, the list price of a full size "The Helix Ovalizer 36/12" with duct forming members twelve feet in length (known as "mandrels" in the terminology employed by Spiral-Helix, Inc.) is approximately $250,000.00.

One limitation of ovalizers employing a right angle motion translation mechanism is that design compromises must be made among factors such as the length of the duct forming members (and therefore the longest section of ductwork that can be formed), the stroke (the distance of the relative movement of the duct forming members between the fully retracted position and the position where they are farthest apart), the force and stroke of the hydraulic cylinder used to drive the actuator rod, and structural requirements of the actuator rod. The mechanical advantage of the motion translation mechanism (either pivoting linkage arms or inclined planes) determines the relationship of the stroke of the duct forming members to the stroke of the actuator rod. Increasing either the stroke of the duct forming members (greater strokes are desirable) or the length of the duct forming members in general requires a greater force from the hydraulic cylinder.

As an alternative to mechanical linkages for translating longitudinal motion of an actuator rod to uniform motion of duct forming members away from each other, it has also been proposed to force the duct forming members apart by means of directly-attached hydraulic cylinder assemblies, with no motion translation required. One example is disclosed in Goodwin U.S. Pat. No. 4,571,980. The disclosed Goodwin duct-shaping machine employs a pair of duct forming members, reinforced with "I" beams, that are effectively placed inside a ductwork section to be formed. An hydraulic cylinder assembly is connected at each end of the duct forming members to force them apart. The disclosed Goodwin machine in addition has a pair of side compactors which engage exterior surfaces of the ductwork section being formed so as to flatten the sides of the duct along a minor axis, while the interior duct forming members are moving apart along the major axis. A related apparatus for "arching" corrugated steel drainage pipes, related in that hydraulic cylinders are employed to directly force out pipe forming segments, is disclosed in Brinegar U.S. Pat. No. 4,914,939.

Notwithstanding the disclosure of Goodwin U.S. Pat. No. 4,571,980, there are significant practical difficulties in devising an ovalizer which employs direct actuation of the duct forming members by hydraulic cylinders, which perhaps explains in part why the right angle motion translation mechanism approach of the ovalizers manufactured by Spiral-Helix, Inc. are what, heretofore, have primarily been available in the marketplace.

A significant factor is the relatively high force involved to form round ductwork to oval (at least in the absence of the minor axis compaction assemblies of Goodwin), and additionally to stretch the sheet metal approximately one percent, by slightly exceeding the yield strength of the duct metal, so that the oval shape is retained. The force required ranges from approximately 20,000 pounds per lineal foot along the lengths of the duct forming members in the case of 26 gage ductwork to 34,000 pounds per lineal foot along the lengths of the duct forming members of the case of spiral duct made of 16 gage sheet metal. A practical ovalizer has duct forming members that are ten feet in length, requiring a total force of approximately 340,000 pounds. Providing a structural beam to sustain such forces without undue bending if driven from the ends as disclosed in Goodwin U.S. Pat. No. 4,571,980 would be quite difficult.

The pipe arching apparatus of Brinegar U.S. Pat. No. 4,914,939 employs a plurality of cylinders, but still only two per individual forming segment. The requirements of a pipe arching apparatus, as disclosed in Brinegar U.S. Pat. No. 4,914,939, and the requirements of a spiral duct ovalizer differ significantly.

SUMMARY OF THE INVENTION

Accordingly, it is an object of the invention to provide a versatile, cost-effective ovalizer for forming round ductwork to oval.

It is another object of the invention to provide an ovalizer capable of a greater stroke compared to prior art ovalizers.

It is yet another object of the invention to provide an ovalizer which employs a plurality of hydraulic cylinders directly driving a pair of spaced-apart duct forming members.

It is a related object of the invention to provide an approach to ovalizer construction in which the length of the duct forming members can be increased by increasing the number of hydraulic cylinder assemblies, without requiring any increase in the force or stroke of the individual hydraulic cylinder assemblies.

It is another related object of the invention to provide an ovalizer which does not require the duct forming members to have undue beam strength.

Briefly, and in accordance with the invention, an ovalizer, particularly for but not limited to spiral seamed metal duct, includes a pair of elongated and laterally spaced-apart duct forming members sized to fit within a ductwork section and to bear against opposing interior surfaces thereof. Preferably, each of the duct forming members includes a structural beam and a semi-cylindrical head that can be repeatedly installed on and removed from the structural beam. For versatility, there is provided a set of semi-cylindrical heads of different diameters corresponding to the minor axes of different sizes of oval ductwork after forming, for selective installation on the structural beams. In addition, there is provided a set of spacers that can be installed between the structural beam and the semi-cylindrical head of one of the duct forming members.

A plurality of hydraulic cylinder assemblies are spaced longitudinally along and between the duct forming members for forcing the duct forming members apart. For example, five hydraulic cylinder assemblies may be spaced along a pair of duct forming members which are ten feet in length. Preferably, the hydraulic assemblies are double-acting hydraulic cylinder assemblies and operate to selectively move the duct forming members apart for duct forming, and towards each other for member retraction.

The ovalizer additionally includes a plurality of signal-controlled valves. Each of the controlled valves is connected for controlling the application of hydraulic fluid under pressure to a corresponding one of the hydraulic cylinder assemblies for selectively causing the corresponding hydraulic cylinder assembly to extend, as well as to retract in the case of double-acting hydraulic cylinder assemblies.

In the illustrated embodiment, the signal-controlled valves are signal-activated double-acting directional control valves which operate in a simple on/off manner, and there are separate manually-adjustable flow restrictors. More sophisticated signal-controlled valves may alternatively be employed, in particular servo valves, where flow rate can be automatically controlled.

A significant aspect of the invention is a feedback control system (servomechanism) which ensures that the hydraulic cylinder assemblies extend together at approximately the same rate and stop when a predetermined extended position is reached, and also ensures that the hydraulic cylinder assemblies retract together at approximately the same rate and stop when a predetermined retracted position is reached.

The feedback control system makes practical an ovalizer which employs direct actuation of the duct forming members by hydraulic cylinders. The feedback control system allows multiple hydraulic cylinders to be employed, as many as are required to produce the required force, and over any desired practical length of duct forming members. Beam strength requirements of the duct forming members are greatly reduced when the hydraulic cylinder assemblies can be positioned adjacent each other along the duct forming members.

In the absence of the feedback control system, and in view of the relatively high forces involved during operation of an ovalizer, any differences in the positions of the individual hydraulic cylinder assemblies due to inevitable differences in their rates of extension and retraction would likely result in mechanical damage to the structure of the ovalizer.

Even with feedback control in accordance with the invention, slight differences in the extensions and retractions among the individual hydraulic cylinders can result, which has the potential to structurally damage the ovalizer. Accordingly, the hydraulic cylinder assemblies are resiliently mounted to at least one of the duct forming members to accommodate differences in the extensions and retractions of individual ones of the hydraulic cylinder assemblies without damage to this ovalizer.

More particularly, the feedback control system includes a plurality of position transducers connected to corresponding ones of the hydraulic cylinder assemblies. Each of the position transducers outputs a position signal indicating the position (i.e. distance of extension or retraction) of the corresponding hydraulic cylinder assembly.

The feedback control system additionally includes a programmed controller connected to the position transducers for receiving the individual position signals, and connected to the valves for individually controlling the valves.

In general the controller is operable, when it is desired to extend the hydraulic cylinder assemblies to force the duct forming members apart, to control the valves while monitoring the outputs of the position transducers in a manner such that the hydraulic cylinder assemblies extend together at approximately the same rate and stop when a predetermined extended position is reached. Similarly, the controller is operable, when it is desired to retract the hydraulic cylinder assemblies to retract the duct forming members, to control the valves while monitoring the outputs of the position transducers in a manner such that the hydraulic cylinder assemblies retract together at approximately the same rate and stop when a predetermined retracted position is reached.

In a more particular aspect of the invention, the controller is operable, when it is desired to extend the hydraulic cylinder assemblies to force the duct forming members apart, to activate the control valves in a manner which directs hydraulic fluid to the hydraulic fluid assemblies for extending the hydraulic cylinder assemblies. The controller is further operable, when the position signal from any one of the position transducers indicates that the corresponding hydraulic cylinder assembly has extended to a predetermined extended position, to individually de-activate the corresponding control valve. The controller is still further operable, when the position signals from the position transducers indicate that any one of the hydraulic cylinder assemblies has extended to a position which is a predetermined threshold distance, for example, less than 1/64 inch, beyond the extended position of another one of the hydraulic cylinder assemblies, to individually de-activate the control valve corresponding to the one hydraulic cylinder assembly until the other hydraulic assembly extends to the position of the one hydraulic cylinder assembly.

Correspondingly, and in the case where the hydraulic cylinder assemblies are double-acting cylinder assemblies, when it is desired to retract the hydraulic cylinder assemblies to retract the duct forming members, the controller is operable to activate the control valves in a manner which directs hydraulic fluid to the hydraulic cylinder assemblies for retracting the hydraulic cylinder assemblies, and is further operable, when the position signal from any one of the position transducers indicates that the corresponding hydraulic cylinder assembly has retracted to a predetermined retracted position, to individually de-activate the corresponding control valve. The controller is still further operable, when the position signals from the linear position transducers indicate that any one of the hydraulic cylinder assemblies has retracted to a position which is the predetermined threshold distance beyond the retracted position of another one of the hydraulic assemblies, to individually de-activate the control valve corresponding to the one hydraulic assembly until the other hydraulic cylinder assembly retracts to the position of the one hydraulic cylinder assembly.

To enhance the particular feedback control action, in which the control valves operate in an on/off manner, the ovalizer additionally includes a plurality of adjustable flow restrictors connected for individually restricting the rate of flow of hydraulic fluid to the hydraulic cylinder assemblies for extending and for retracting the hydraulic cylinder assemblies. As a result, the apparatus can be adjusted so that, when all of the control valves are activated in a manner which directs hydraulic fluid to the hydraulic cylinder assemblies for extending the hydraulic cylinder assemblies, the hydraulic cylinder assemblies extend at approximately the same rate, for example approximately ½ inch per second. Likewise, when all of the control valves are activated in a manner which directs hydraulic fluid to the hydraulic cylinder assemblies for retracting the hydraulic cylinder assemblies, the hydraulic cylinder assemblies retract at approximately the same rate, again, for example, approximately ½ inch per second.

Even with the inclusion of individual position transducers and operation of the control valves summarized hereinabove to implement feedback control, slight differences in the extensions and retractions among the individual hydraulic cylinders result, which has the potential to structurally damage the ovalizer. Accordingly, the hydraulic cylinder assemblies are resiliently mounted to at least one of the duct forming members to accommodate differences in the extensions and retractions of individual ones of the hydraulic cylinder assemblies, at least as great as the predetermined threshold distance, without damage to the ovalizer.

The ovalizer additionally includes an operator input device and a display device connected to the controller. The controller is operable, via the operator input device, to accept an input from an operator of the ovalizer specifying a desired oval ductwork size and to determine a round ductwork size, a hydraulic cylinder assembly stroke, a spacer size, if any, and to output to the operator, via the display device, at least the determined round ductwork size and the determined spacer size, if any.

BRIEF DESCRIPTION OF THE DRAWINGS

While the novel features of the invention are set forth with particularity in the appended claims, the invention, both as to organization and content, will be better understood and appreciated, from the following detailed description, taken in conjunction with the drawings, in which:

DETAILED DESCRIPTION

Figure 1:
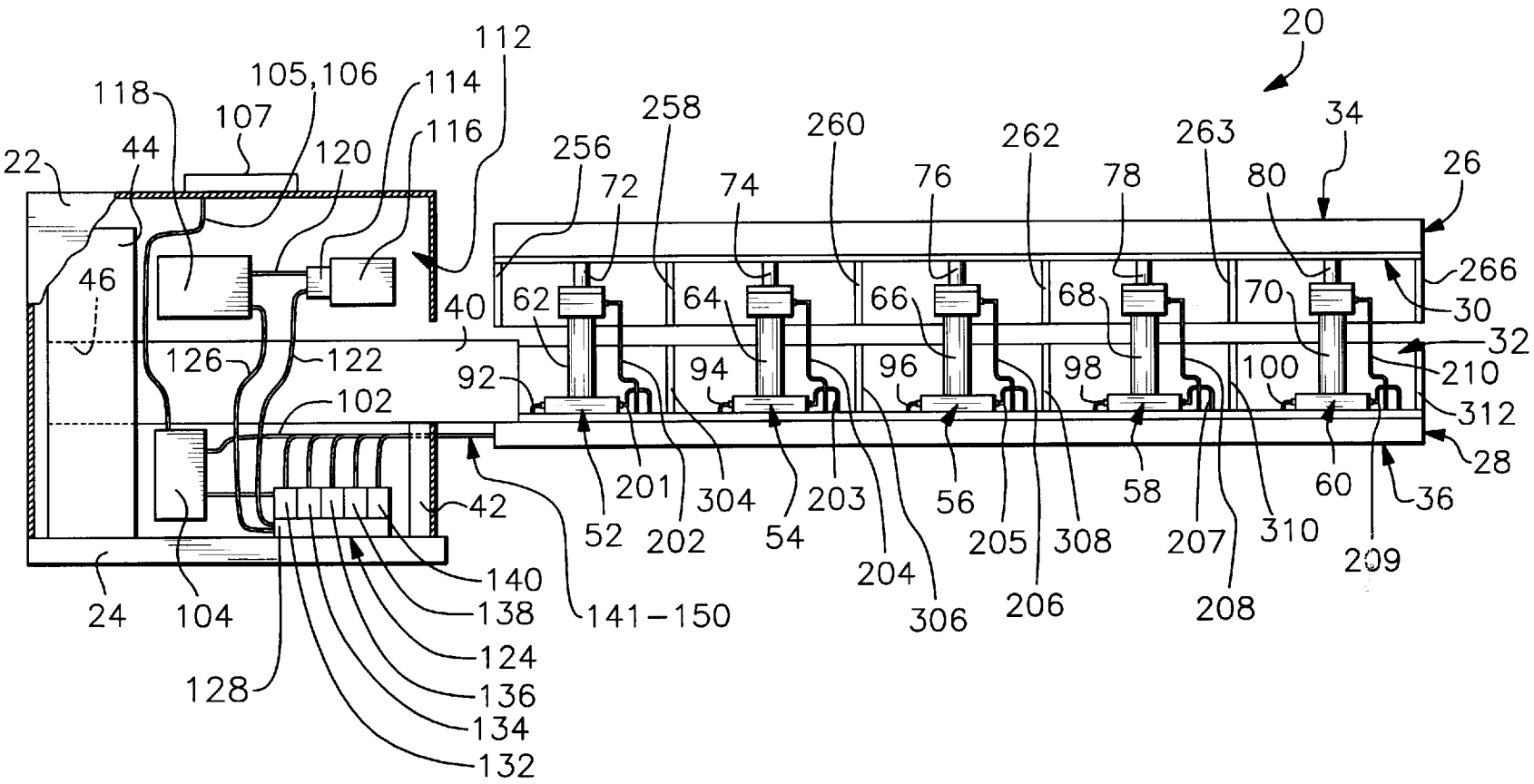
FIG. 1 is a side elevational view of an ovalizer in accordance with the invention in its retracted position.
Figure 2:
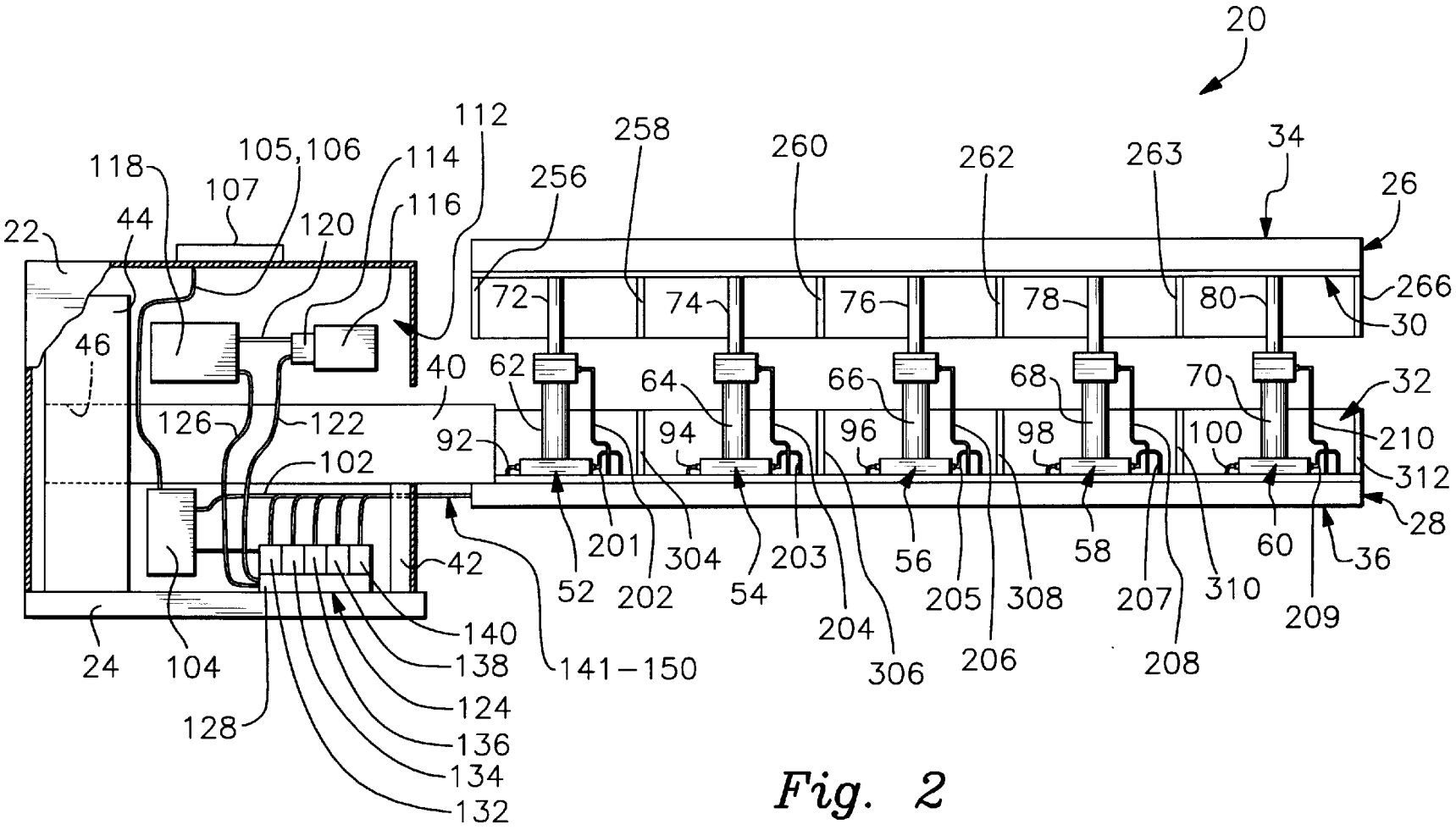
FIG. 2 is a side elevational view of the ovalizer in its extended position.

Referring first to FIGS. 1 and 2, an hydraulically operated ovalizer 20 is shown in its retracted position in FIG. 1, and in its extended position in FIG. 2. The ovalizer 20 includes a machinery cabinet 22 supported on a base 24, and a pair of elongated and laterally spaced-apart duct forming members 26 and 28 project therefrom in a cantilever construction. The duct forming members 26 and 28 are sized to fit within a ductwork section as is described hereinbelow with reference to FIG. 6, and to bear against opposing interior surfaces of the ductwork section. In the particular embodiment described herein, the duct forming members 26 and 28 are ten feet in length, and have a stroke of eight inches between the retracted position of FIG. 1 and the extended position of FIG. 2.

The duct forming members 26 and 28 include respective structural beams 30 and 32, and semi-cylindrical heads 34 and 36 that can be repeatedly installed on and removed from the structural beams 30 and 32. The lower structural beam 32 is welded to a heavy steel rectangular support tube 40, supported near the front of the cabinet 22 by a support structure 42 resting on the cabinet base 24. The rectangular support tube 40 extends inside the cabinet to a concrete counterweight 44 at the rear of the cabinet 22, and is received within a sleeve 46, and secured by bolts (not shown). For transport of the ovalizer 20, the rectangular support tube 40 with duct forming members 26 and 28 attached, is detachable from the cabinet 22.

Figure 3:
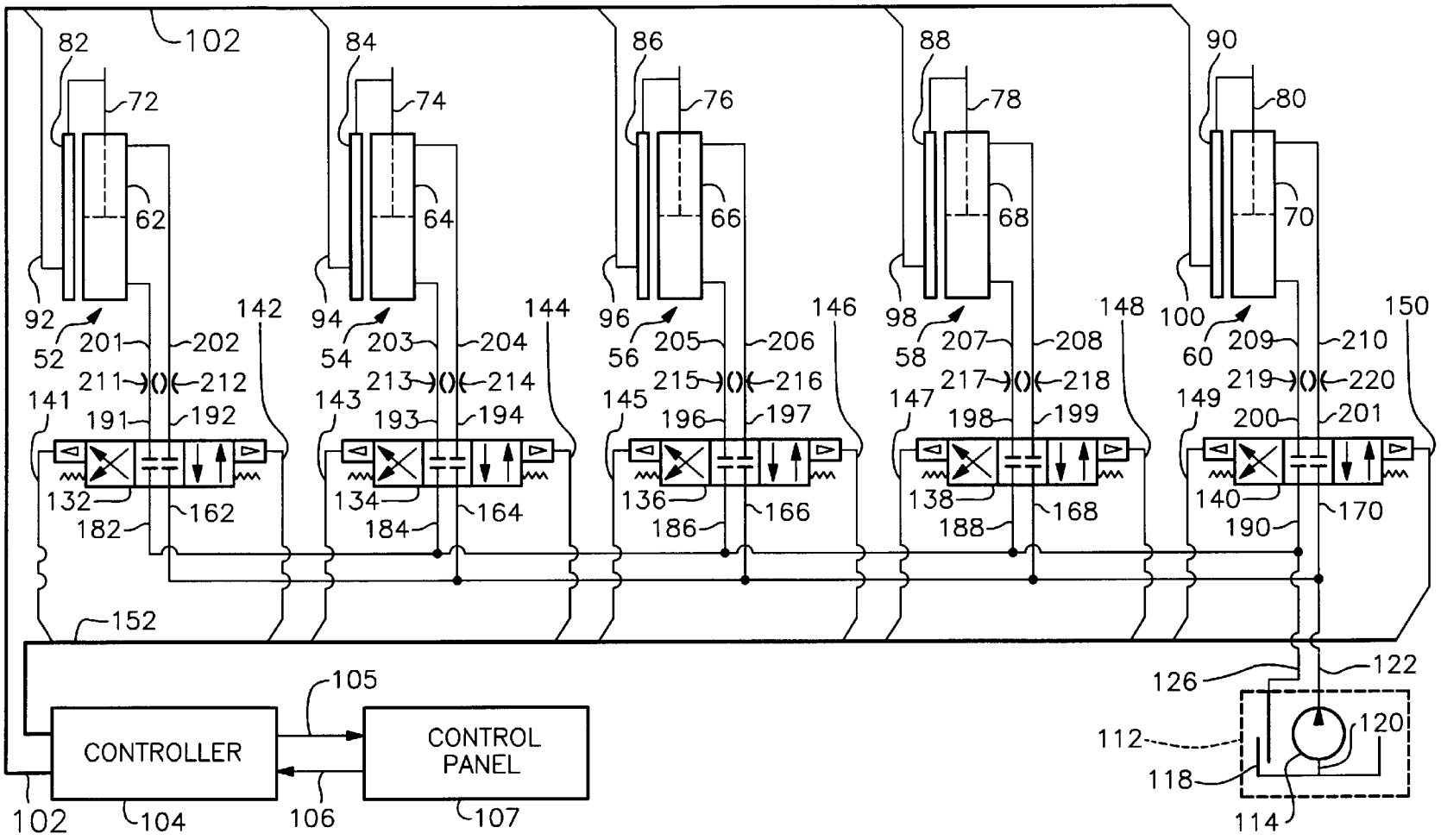
FIG. 3 is a schematic diagram depicting hydraulic and electrical connections between elements of the ovalizer.

Referring, in addition to FIGS. 1 and 2, to the schematic representation of FIG. 3, spaced longitudinally along and between the duct forming members 26 and 28 are double-acting hydraulic cylinder assemblies 52, 54, 56, 58 and 60, mechanically connected for selectively moving the duct forming members 26 and 28 apart for duct forming, and towards each other for retraction of the duct forming members 26 and 28. The hydraulic cylinder assemblies 52, 54, 56, 58 and 60 have respective cylinder bodies 62, 64, 66, 68 and 70, and respective cylinder shafts 72, 74, 76, 78 and 80.

The illustrated ovalizer 20 has duct forming members 26 and 28 which are ten feet in length, although it will be appreciated that the principles of the invention will accommodate cantilever duct forming members 26 and 28 in longer lengths, subject to structural limitations of the cantilever beam configuration, as well as its weight. In FIGS. 1 and 2, the hydraulic cylinder assemblies 52, 54, 56, 58 and 60 are spaced two feet apart center-to-center, and the end hydraulic cylinder assemblies 52 and 60 are spaced one foot from the respective end of each of the duct forming members 26 and 28. The structure is designed so that a force in excess of 34,000 pounds per linear foot can be applied. Thus each individual one of the hydraulic cylinder assemblies 52, 54, 56, 58 and 60 can provide a force of approximately 68,000 pounds, for a total force of 340,000 pounds.

In order to measure the position (i.e. the amount of extension or retraction) of the individual hydraulic cylinder assemblies 52, 54, 56, 58 and 60 for feedback control, there is a corresponding plurality of linear position transducers 82, 84, 86, 88, and 90 (shown in FIG. 3 only), each connected to a corresponding one of the hydraulic cylinder assemblies 52, 54, 56, 58, and 60. The linear position transducers 82, 84, 86, 88 and 90 can be either internal or external to the hydraulic cylinder assemblies. In the illustrated embodiment, the linear position transducers are internal to the hydraulic cylinder assemblies, which, for example, are Parker Model No. 6.00 HH2HXLTS9A X 8.00 double-acting hydraulic cylinder assemblies, with internal LRT feedback linear position transducers.

The linear position transducers 82, 84, 86, 88 and 90 accordingly output position signals on respective output signal lines 92, 94, 96, 98 and 100. The individual transducer output signal lines 92, 94, 96, 98 and 100 are physically collected into a bus 102, connected as an input to a controller 104.

Figure 4:
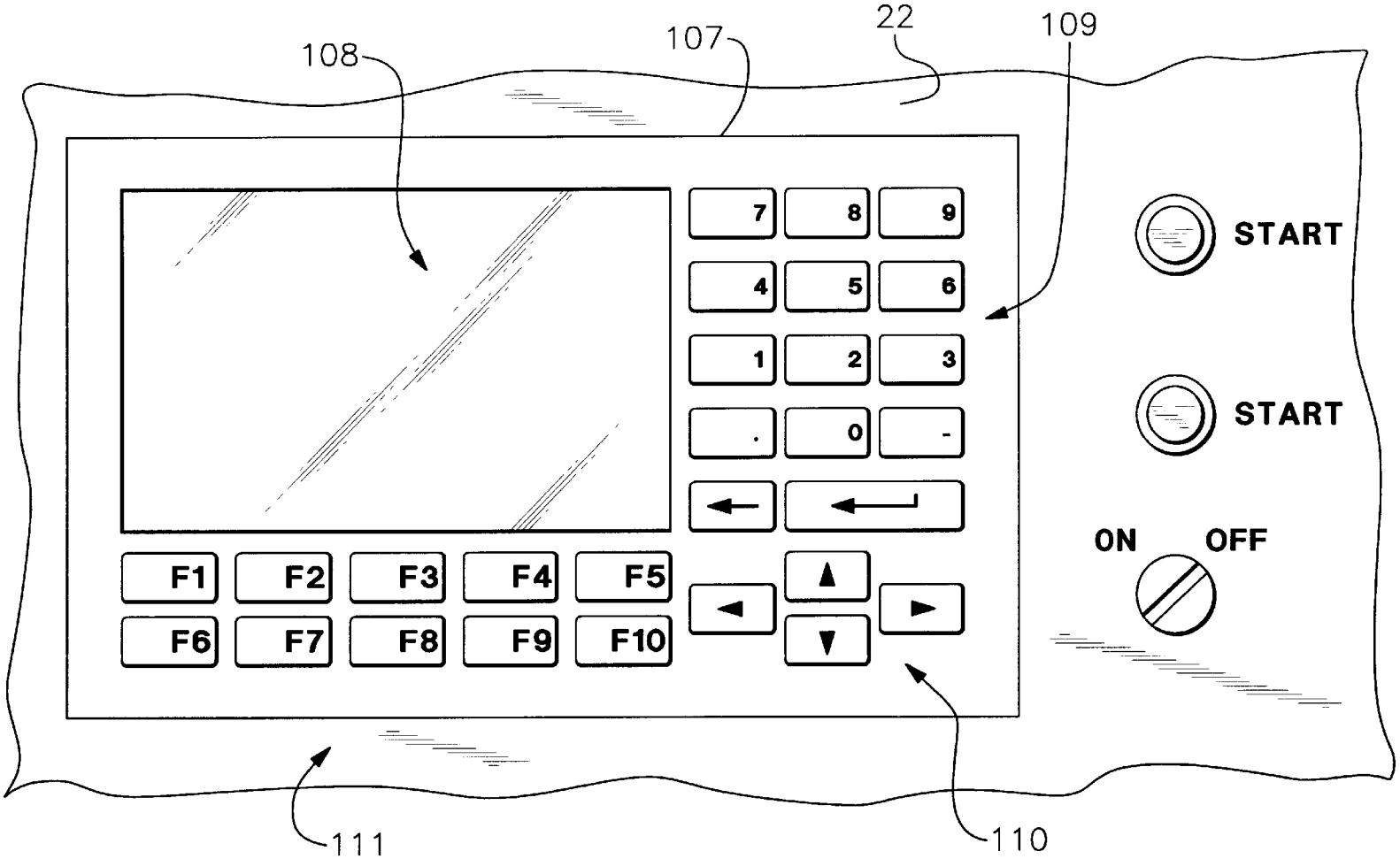
FIG. 4 depicts the control panel of the ovalizer, including a keyboard and a flat panel display device.

A suitable controller 104 is assembled from Allen Bradley components, including an SLC 5/03 Processor Model No. 1747-L532, a Model No. 1746-P2 power supply, a Model No. 1746-A7 seven slot rack, two Model No. 1746-N14 four channel analog input cards, one Model No. 1746-1B8 eight point input card, one Model No. 1746-OW16 sixteen point output card, and a Model No. 1746-PIC converter card. The controller 104 is connected via lines 105 and 106 to a control panel 107, which may be an Allen Bradley Model No. 2711-B5A5 "PanelView 550," incorporating a touch-input and LCD display panel 108 (FIG. 4), and user input keys organized as a set 109 of numeric keys, a set 110 of cursor control keys and a set 111 of function keys (FIG. 4).

Also included within the cabinet 22 is an hydraulic power unit 112, comprising a piston pump 114 with HP control, such as a Parker Model No. PVP33362 RH, driven by a 15 hp electric motor 116 rotating at 1725 rpm, and a sixty-gallon hydraulic fluid reservoir 118. The pump 114 draws fluid from the reservoir 118 via a conduit 120, and supplies hydraulic fluid under pressure via a conduit 122 to a manifold and valve assembly 124. Hydraulic fluid is returned from the manifold and valve assembly 124 to the reservoir 118 via a conduit 126. Although not illustrated, it will be appreciated that the hydraulic power unit 112 includes a number of other conventional elements, such as pressure relief valves, a bypass conduit and filters.

The manifold and valve assembly 124 may, for example, comprise a Daman Model No. AD03HP052 S/C five station high flow manifold 128, and a set of five Parker Model No. D1VW1CNJC double-acting 24 VDC directional control valves 132, 134, 136, 138 and 140 connected to corresponding respective ones of the hydraulic cylinder assemblies 52, 54, 56, 58, and 60, as is best seen in FIG. 3.

The control valves 132, 134, 136, 138, and 140 are activated by signals from the controller 104. Thus, individual valve-actuating signal lines 141 and 142 are connected to the valve 132; individual valve-actuating signal lines 143 and 144 are connected to the valve 134; individual valve-actuating signal lines 145 and 146 are connected to the valve 136; individual valve-actuating signal lines 147 and 148 are connected to the valve 138; and individual valve-actuating signal lines 149 and 150 are collected to the valve 140. The signal lines 141–150 are collected into a representative bus 152. While electrically controlled valves are shown, other forms of control may be employed, such as pneumatically actuated valves.

Although the manifold 128 of FIGS. 1 and 2 is not shown in the schematic representation of FIG. 3, it will be appreciated that the manifold 128 serves in effect to connect high pressure conduit 122 from the hydraulic power unit 112 to respective valve input ports 162, 164, 166, 168 and 170, and to return hydraulic fluid via the conduit 126 to the reservoir 118 from valve output ports 182, 184, 186, 188 and 190.

The valves 132, 134, 136, 138 and 140 are connected to the hydraulic cylinder assemblies 52, 54, 56, 58 and 60 so as to direct hydraulic fluid under pressure to the respective hydraulic cylinder assemblies in a manner which selectively extends and retracts the hydraulic assemblies, and more specifically the respective cylinder shafts 72, 74, 76, 78 and 80, in response to control signals from the controller 104.

More particularly, control valve 132 has ports 191 and 192 connected via conduits 201 and 202 for respectively extending and retracting the hydraulic cylinder assembly 52; control valve 134 has ports 193 and 194 connected via conduits 203 and 204 for respectively extending and retracting the hydraulic cylinder 54; control valve 136 has ports 195 and 196 connected via respective conduits 205 and 206 for respectively extending and retracting hydraulic cylinder 56; control valve 138 has ports 197 and 198 connected via conduits 207 and 208 to hydraulic cylinder 58 for respectively extending and retracting hydraulic cylinder 58; and control valve 142 has ports 199 and 200 connected via conducts 209 and 210 for respectively extending and retracting the cylinder shaft 80 of the hydraulic cylinder assembly 60.

Also depicted in FIG. 3 are a plurality of adjustable flow restrictors 211–220 connected for individually restricting the rate of flow of hydraulic fluid to the hydraulic cylinder assemblies 52, 54, 56, 58 and 60 for extending and retracting the hydraulic cylinder assemblies. By means of the adjustable flow restrictors 211–220, the ovalizer 20 can be adjusted so that, when all of the control valves 132, 134, 136, 138 and 140 are activated in a manner which directs hydraulic fluid via conduits 201, 203, 205, 207, and 209 for extending the cylinder shafts 72, 74, 76, 78, and 80 of the hydraulic cylinder assemblies 52, 54, 56, 58 and 60, all of the hydraulic cylinder assemblies extend at approximately the same selected rate. This adjustment minimizes the number of times the individual control valves 132, 134, 136, 138 and 140 have to be de-activated and re-activated during an extension operation to maintain the same rate of extension among the individual hydraulic cylinder assemblies 52, 54, 56, 58 and 60. In addition, when all of the control valves 132, 134, 136, 138 and 140 are activated in a manner which directs hydraulic fluid via the conduits 202, 204, 206, 208 and 210 for retracting the hydraulic cylinder assemblies 52, 54, 56, 58 and 60, all of the hydraulic cylinder assemblies retract at the same selected rate. Although the adjustable flow restrictor valves 211–220 are schematically shown connected in series with the conduits 201–210, respectively, it will be appreciated that different physical arrangements are possible, depending upon the design of the particular control valves 132, 134, 136, 138 and 140 selected, and the adjustable flow restrictors 211–220 may be part of the same assembly.

Thus, the rate of extension and the rate of retraction are independently adjustable for each of the hydraulic cylinder assemblies 52, 54, 56, 58 and 60. Typically, the flow restrictors 211–220 are adjusted so that the hydraulic cylinder assemblies 52, 54, 56, 58, and 60 both extend and retract at a rate of approximately ½ inch per second.

Although the illustrated embodiment employs what are essentially simple on/off control valves 132, 134, 136, 138 and 140, in combination with manually-adjustable flow restrictors 211–220, more sophisticated servo valves (not shown) may be employed. In the case of servo valves, the controller 104 is able to individually control the flow rate through the individual valves, and a more sophisticated form of feedback control may be implemented. The illustrated embodiment is however cost-effective, and functions well.

The constructional details of the representative ovalizer 20 will now be described in greater detail.

Figure 5:
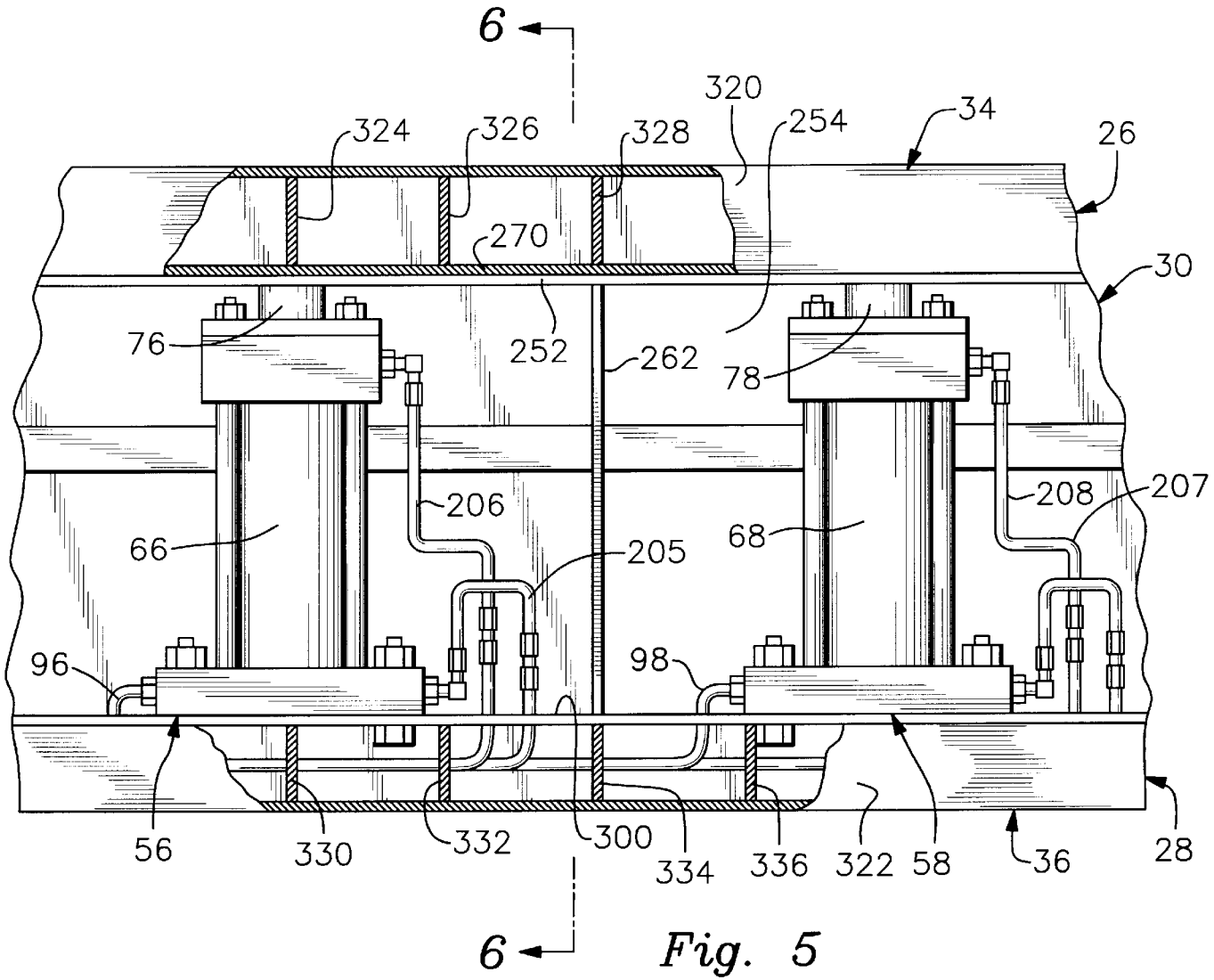
FIG. 5 is an enlarged side elevational view, partially broken away, with the ovalizer in the retracted position of FIG. 1, letter showing details of two of the hydraulic cylinder assemblies, and with portions of the duct forming members partially broken away to show internal constructional details thereof.
Figure 6:
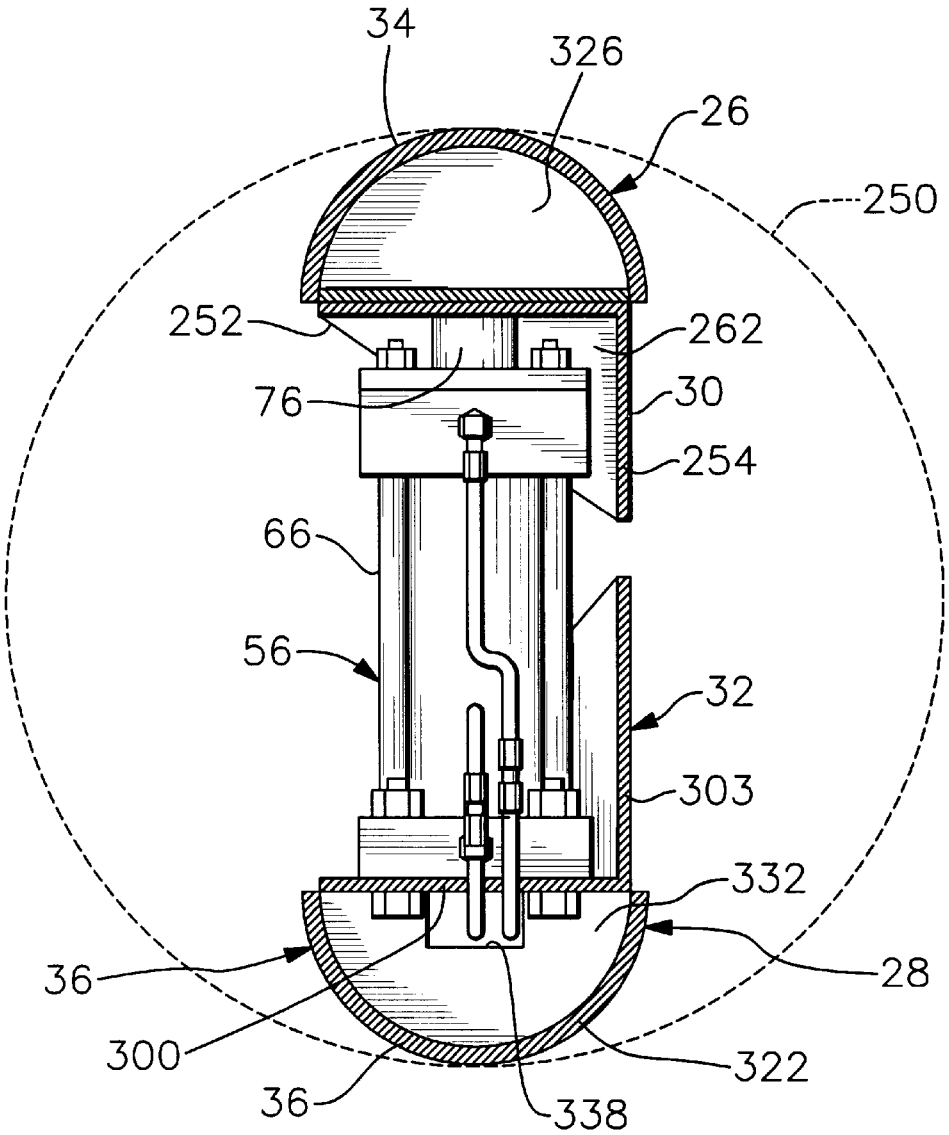
FIG. 6 is a cross-section taken on line 6—6 of FIG. 5, additionally representing, in dash lines, a section of round spiral ductwork prior to forming.
Figure 7:
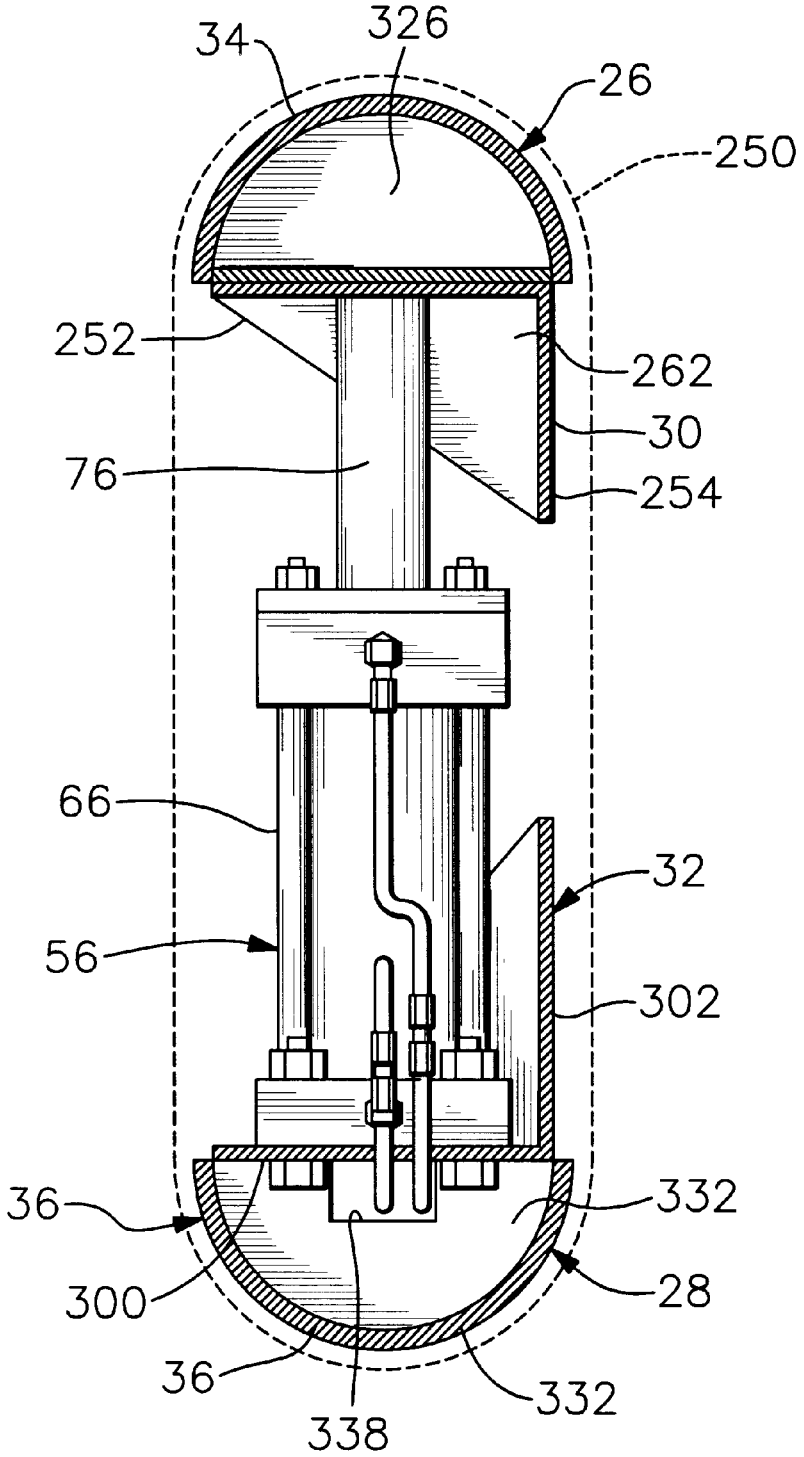
FIG. 7 is a similar cross-section, with the duct forming members in their extended position, and with the round duct represented in FIG. 6 formed to oval.

FIG. 5 is an enlarged view showing a cut away portion of each of the duct forming members 26 and 28, and two of the double-acting hydraulic cylinder assemblies 56 and 58. FIG. 6 is a cross-section taken on line 6—6 of FIG. 5, additionally showing in cross-section a representative round ductwork section 250, prior to forming to oval. FIG. 6 corresponds to the retracted position of FIG. 1 and FIG. 7 corresponds to the extended position of FIG. 2.

In FIGS. 5 and 6, the structural beam 30 of the upper duct forming member 26 is seen to comprise an L-beam, which may also be described as a top support angle 30, having a top plate 252 joined at right angles to a side plate 254, positioned so as to clear the bodies of the hydraulic cylinder assemblies, such as the body 66 of the hydraulic cylinder assembly 56 shown in FIG. 6. Triangular gussets 256, 258, 260, 262, 264 and 266, best seen in FIGS. 1 and 2, extend between the top plate 252 and the side plate 254, located between the hydraulic cylinder assemblies 52, 54, 56, 58 and 60, and at each end of the upper duct forming member 26. As an alternative, the structural beam 30 can have a "U" shape rather than a "L" shape to better balance the forces during operation, but at the expense of somewhat restricting access to the hydraulic cylinder assemblies 52, 54, 56, 58 and 60.

Over the top plate 252 is an additional support plate 270, for better distributing forces imparted by the cylindrical shafts 72, 74, 76, 78 and 80 to the structural beam 30. The additional support plate 270 is secured to the top plate 252 at periodic intravals by suitable recessed fasteners (not shown).

Figure 8:
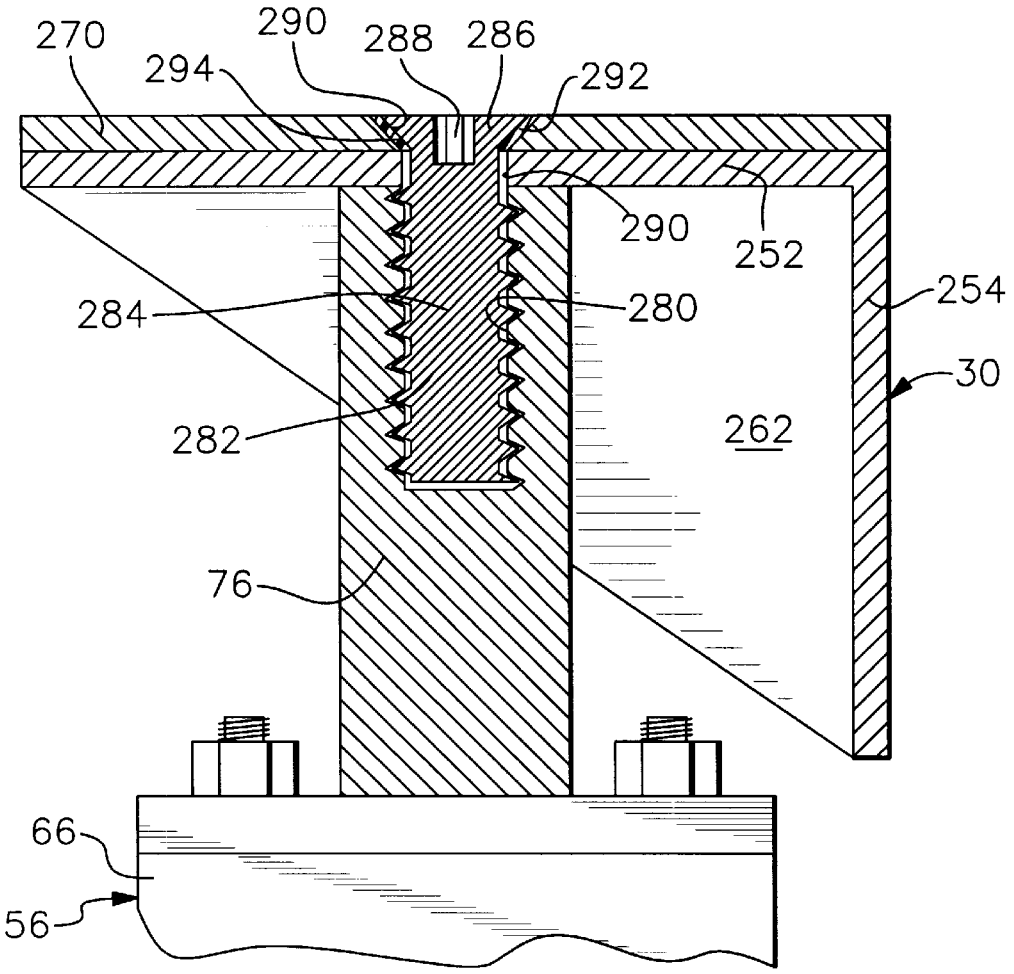
FIG. 8 is a further enlarged cross-sectional view showing the manner in which the hydraulic cylinder assemblies are resiliently mounted to the upper duct forming member.

In addition, and with particular reference to FIG. 8, the cylindrical shafts 72, 74, 76, 78 and 80 of the hydraulic cylinder assemblies 52, 54, 56, 58 and 60 are resiliently mounted to the structural beam 30 of the upper duct forming member 26 to accommodate differences in the extension of individual ones of the hydraulic cylinder assemblies 52, 54, 56, 58 and 60 at least as great as a predetermined threshold distance, for example a threshold distance of 1/64 without structural damage to the ovalizer 20.

As discussed hereinabove, extremely high forces are involved in the operation of the ovalizer 20, and the beams 30 and 32 are quite rigid in order to withstand the operational forces without undue bending of the duct forming members 26 and 28.

Nevertheless, and notwithstanding the feedback control system of the invention employing the linear position transducers 82, 84, 86, 88, and 90, inevitably there are differences in the position (i.e. the amount of extension or retraction) among the individual hydraulic cylinder assemblies 52, 54, 56, 58 and 60. If the cylinder shafts 72, 74, 76, 78 and 80 were rigidly attached to the structural beam 30, an even greater degree of control precision, possibly unattainable, would be required in order to avoid structural damage, most likely damage to the hydraulic cylinder assemblies 52, 54, 56, 58 and 60.

In FIG. 8, representative cylinder shaft 76 of representative hydraulic assembly 56 is resiliently attached to the structural beam 30. Cylinder shaft 76 has a threaded longitudinal bore 280 which receives the threaded portion 282 of a flat head machine screw 284. The machine screw 284 has a flat head 286 with a central socket 288 for receiving a corresponding hex wrench, and passes through an aperture 290 in the top plate 252, and a flanged aperture 292 in the additional support plate 270.

There is a space between the head 286 and flanged aperture 292, which receives a resilient gasket 294, such as an ⅛ inch rubber gasket 294.

By way of example, the cylinder shaft 76 has a diameter of 2½ inches, and the threaded portion 282 of machine screw 284 has a diameter of 1¼ inches.

Referring again to FIGS. 5, 6 and 7, the structural beam 32 of the lower duct forming member 28 likewise is an L-beam which also may be termed a lower support angle 32, having a lower plate 300 and a side plate 302 joined at right angles. A series of triangular support gussets 304, 306, 308, 310 extend between the plates 300 and 302, and there is a rectangular support gusset 312 extending between the plates 300 and 302 at the end of the lower duct forming member 28. The bodies 62, 64, 66, 68, and 70 of the hydraulic cylinder assemblies 52, 54, 56, 58 and 60 are rigidly bolted to the lower plate 300 of the lower support angle 32. As an alternative, the structural beam 32 can have a "U" shape rather than an "L" shape to better balance the forces during operation, but again at the expense of somewhat restricting access to the hydraulic cylinder assemblies 52, 54, 56, 58 and 60.

The semi-cylindrical heads 34 and 36 comprise respective hollow semi-cylindrical shells 320 and 322, respectively, reinforced by internal half-circle gussets, such as representative half-circle gussets 324, 326 and 328 of upper semi-cylindrical shell 320 in FIG. 5, and representative half-circle gussets 330, 332, 334 and 336 in lower hollow semi-cylindrical shell 322.

In the illustrated embodiment, the upper half-circle gussets 324, 326, 328 differ slightly from the lower half-circle gussets 330, 332, 334 and 336. The upper semi-circular gussets 324, 326 and 328 are slightly less than half of a circle to accommodate the thickness of the upper support plate 270, which accordingly is hidden from view.

The lower half-circle gussets 330, 332, 334 and 336 include central cutouts, such as representative cutout 338 visible in the half-circle gusset 332 visible in FIG. 6 in order to provide a passageway for the transducer output signal lines 92, 94, 96, 98 and 100 of the bus 102, and for the individual hydraulic conduits 201, 202, 203, 204, 205, 206, 207, 208, 209 and 210. By means of suitable fittings and connectors, the hydraulic conduits such as conduits 205, 206, 207 and 208 visible in FIG. 5 pass through support plate 300, as do the linear position transducer output signal lines 96 and 98.

Figure 9:
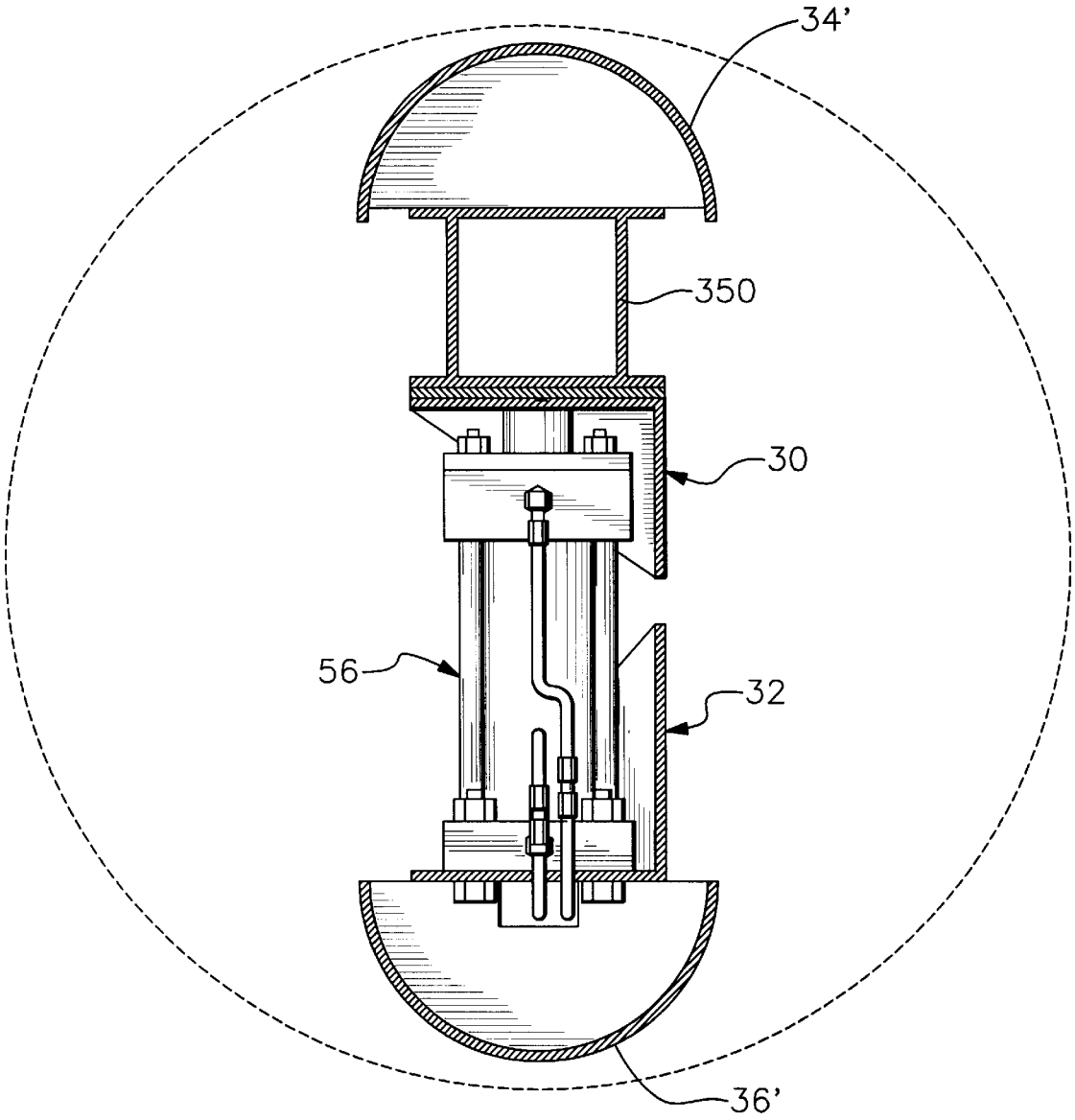
FIG. 9 is a cross-sectional view, similar to that of FIG. 6, showing the manner in which a pair of larger semi-cylindrical heads are mounted, with a spacer employed in combination with the upper head.

FIG. 9, which is a modification of FIG. 6, illustrates representative hydraulic cylinder assembly 56 in its retracted position, with a pair of larger semi-cylindrical heads 34' and 36' fitted to the respective structural beams 30 and 38, and additionally including a spacer 350 between the upper support beam 30 and the semi-cylindrical head 34.

Particular attachments are not shown, as a variety of different techniques may be employed such as bolts, machine screws received in threaded apertures, or rapid-release clips. Likewise, locating pins and suitable receiving apertures are preferably included, which are omitted for purposes of illustration.

Figure 10:
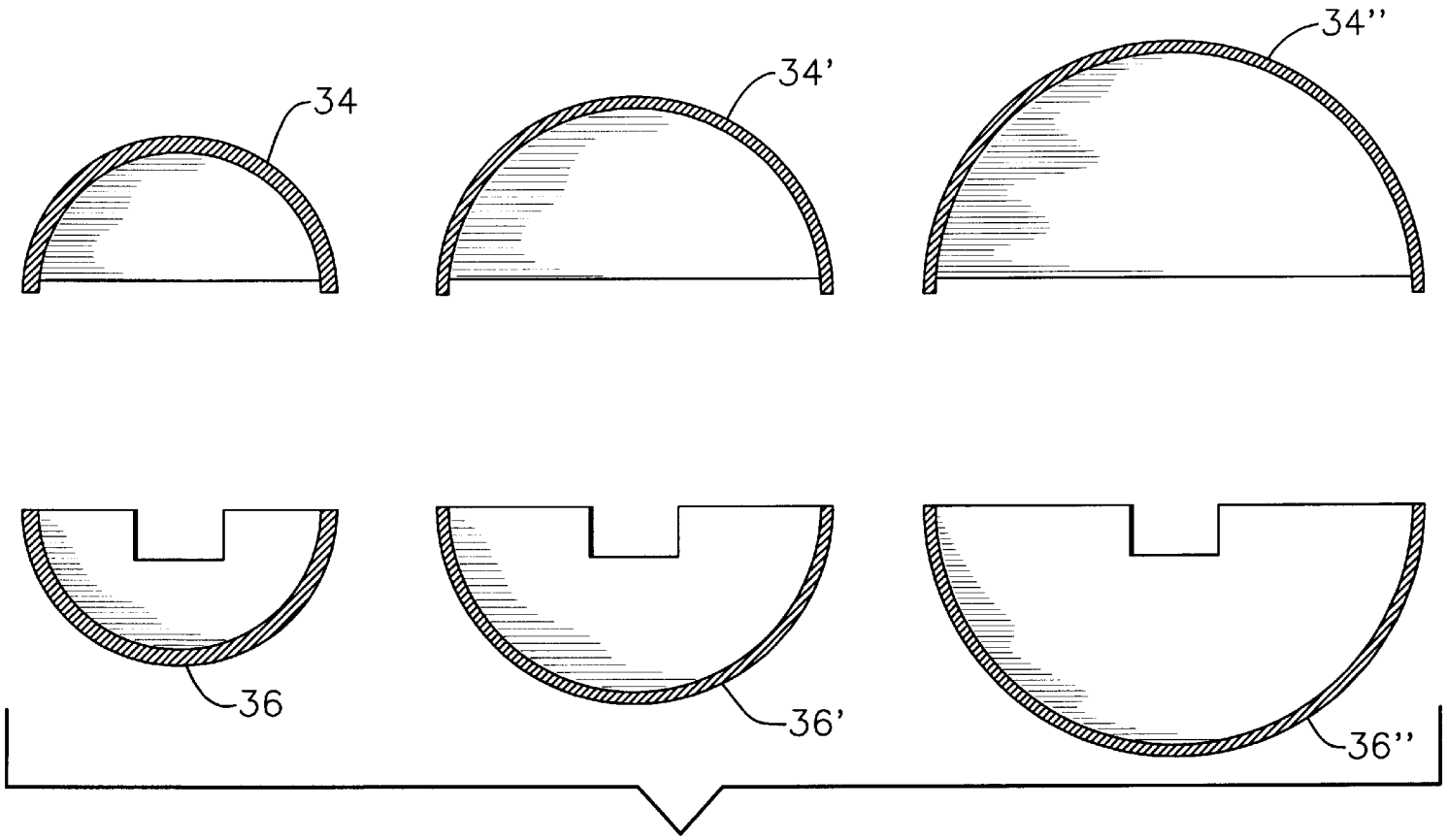
FIG. 10 depicts a set of semi-cylindrical heads of different diameters corresponding to the minor axis of different sizes of oval ductwork after forming for selective installation on the structural beams.

FIG. 10 illustrates a set of semi-cylindrical heads of different diameters corresponding to the minor axis of different sizes of oval ductwork after forming for selected installation on the structural beams 30 and 32. More particularly, FIG. 10 depicts three different sizes of upper semi-cylindrical heads 34, 34' and 34" for mounting over the upper support beam 30, with or without a spacer, and a corresponding set 36, 36' and 36" of semi-circular heads for mounting to the lower support beam 32'.

Figure 11:
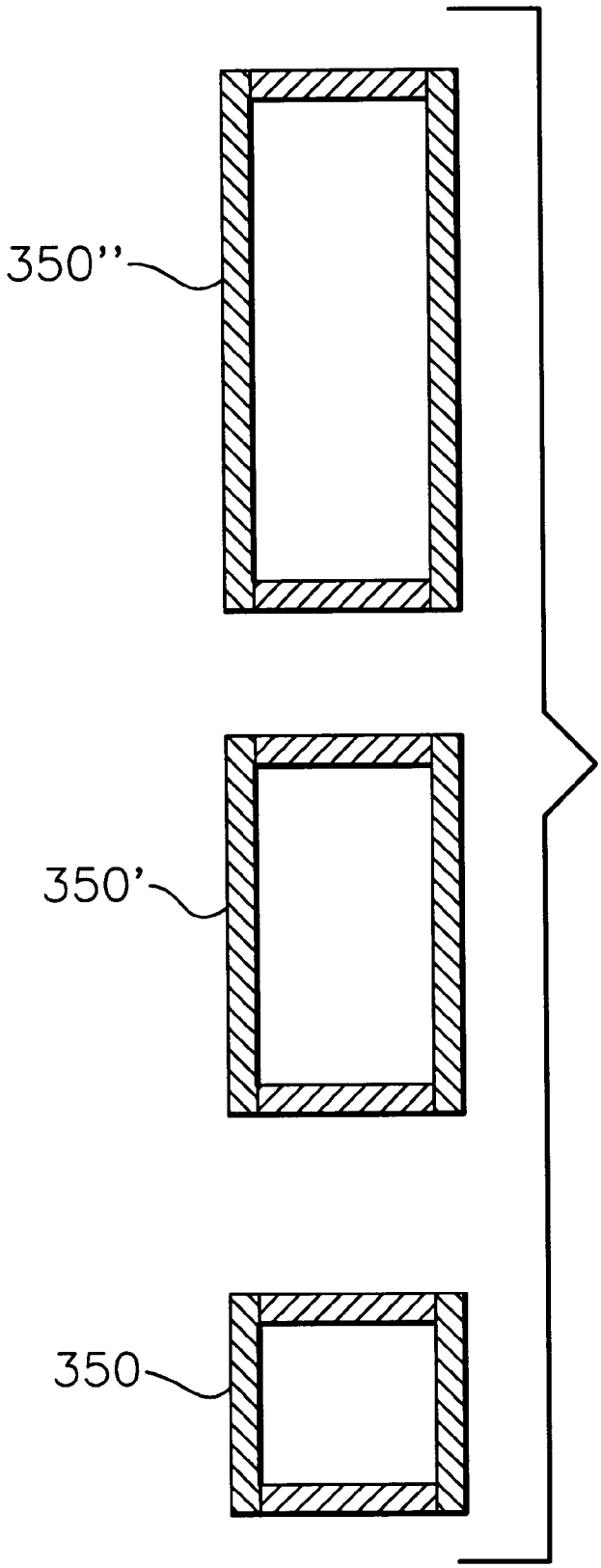
FIG. 11 depicts a set of spacers that can be installed between the structural beam and semi-cylindrical head of the upper one of the duct forming members.
Figure 12A:
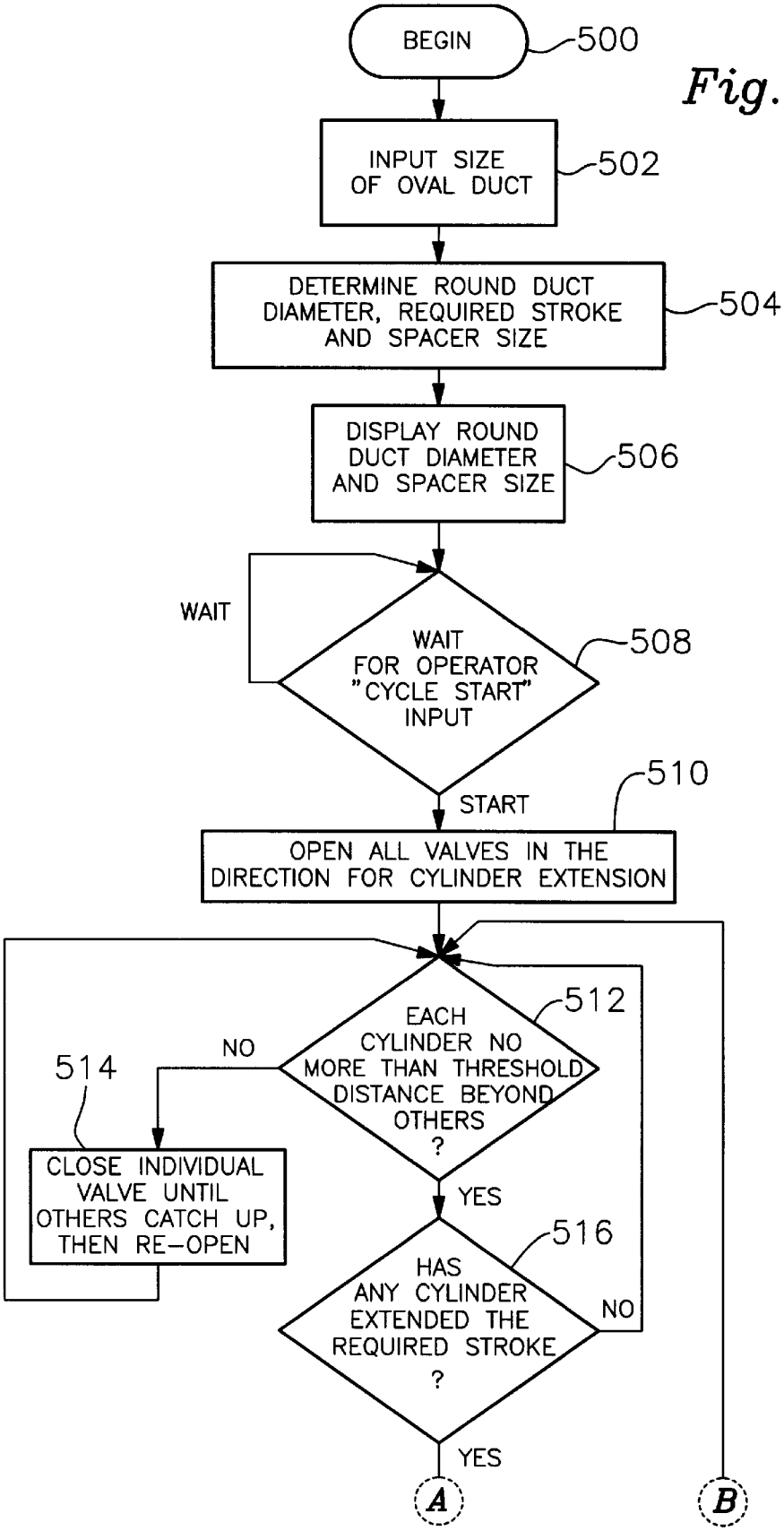
FIGS. 12A, 12B and 12C is a program flow chart depicting programming of the controller.
Figure 12B:
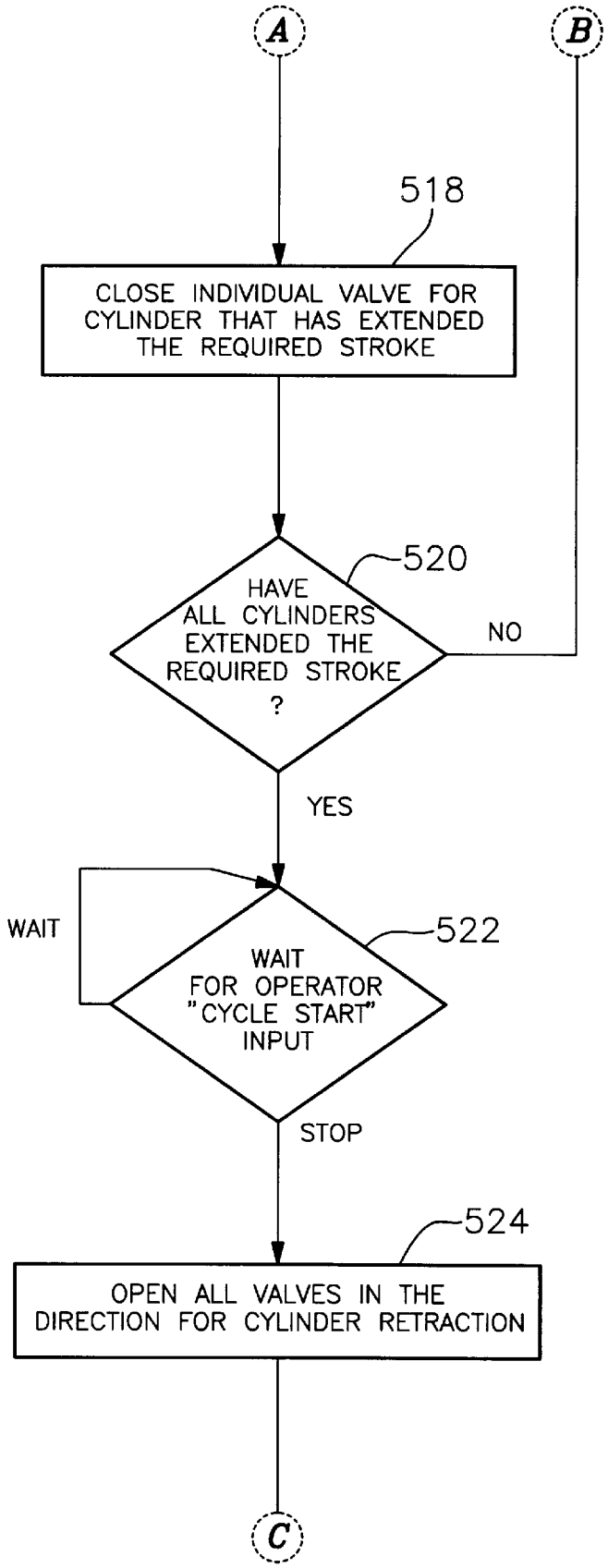
Figure 12C:
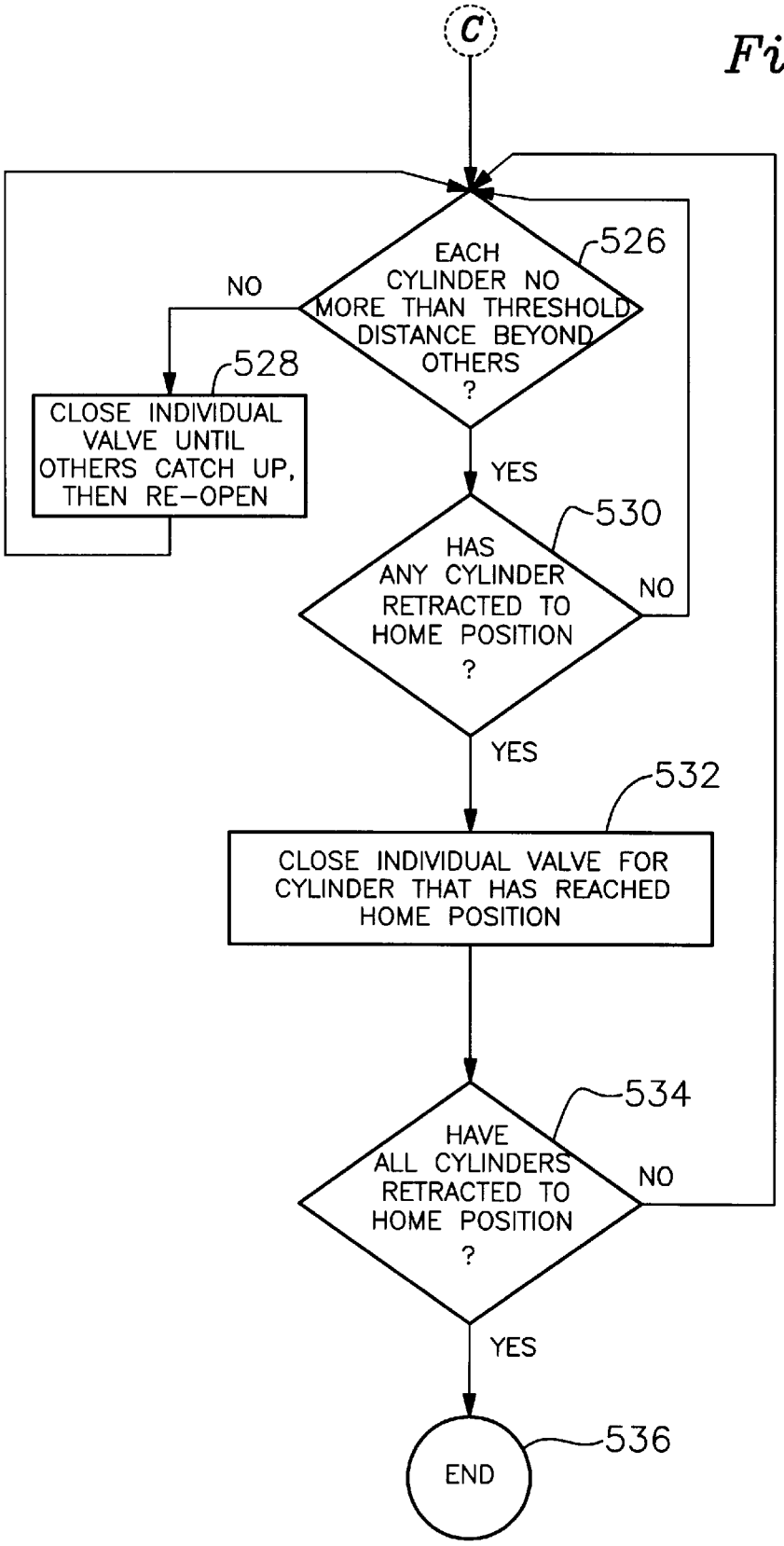

Similarly, FIG. 11 depicts a set of spacers 350, 350' and 350" that can be installed between the structural beam 30 and one of the representative semi-cylindrical heads 34, 34' and 34".

The ovalizer 20 of the invention is capable of forming round duct to oval duct in a variety of sizes. For example, a section of round ductwork twenty-four inches in diameter may be formed to an oval duct having a minor axis of eight inches and a major axis of just over thirty-three inches.

Suitable round ductwork is typically made in diameters ranging from twenty inches to sixty inches, in typically two inch increments. The minor axis of the formed oval ductwork can range from eight inches to twenty-four inches in two inch increments, and then in six-inch increments to thirty inches and thirty-six inches. A typical gage thickness range is 10 gage to 30 gage. With some duct sizes the eight-inch stroke is insufficient to form from circular to oval in one operation, and a simple pre-forming device, such as a boom attached to a forklift truck and cooperating with another stationary boom fixed to a wall may be employed. It will be appreciated that ovalizers in accordance with the invention can be made in both smaller and larger sizes compared to the disclosed ovalizer 20.

The controller 104, in combination with the control panel 107, performs two distinct operational functions, under program control.

The first function is to assist an operator of the ovalizer 20 in determining, based on the desired oval ductwork size: the diameter of round ductwork required; the stroke or extension distance of the hydraulic cylinder assemblies 52, 54, 56, 58 and 60; and the size of the spacer 350 required, if any. The head size corresponds to the minor axis of the oval ductwork.

A second function of the controller 104, operating as a feedback controller in conjunction with the linear position transducers 92, 94, 96, 98 and 80, and in conjunction with the control valves 132, 134, 136, 138 and 140, is to control the application of hydraulic fluid under pressure to the individual hydraulic cylinder assemblies 52, 54, 56, 58 and 60 in a manner which results in all of the hydraulic cylinder assemblies 52, 54, 56, 58 and 60 reaching the desired stroke or extension at the approximately same time, and at approximately the same rate, so that damage to the structure is avoided.

Thus, although adjustment of the adjustable flow restrictors 211–220 can result in approximately the same rate of extension and retraction among the individual hydraulic cylinder assemblies 52, 54, 56, 58 and 60, identical matching is hardly possible, due in part to differing lengths of the conduit 201–210 along the lower duct forming member 28, and in view of variations in the viscosity of the hydraulic fluid with temperature.

Moreover, there are many times when a section of duct less than the full ten foot length of the duct forming members 26 and 28 is to be formed, in which case only portions of the duct forming members 26 and 28 encounter resistance, requiring substantial force from only some of the hydraulic cylinder assemblies 52, 54, 56, 58 and 60, while other ones of the hydraulic cylinder assemblies 52, 54, 56, 58 and 60 are not required to deliver any particular force. In such event, particularly when the point is reached at which the metal of the ductwork begins to stretch, the unloaded hydraulic cylinders will, in the absence of feedback control, extend at a greater rate.

In accordance with the first function of the controller 104, and with reference to the control panel 107 of FIG. 4, the controller 104 is operable to receive user input from the touch display panel 108, from the numeric keypad 109, the cursor keys 110, and the function keys 111. Messages and information is displayed on the touch input display panel 108.

By way of example, the following table is either programmed into the controller 104, or is calculated by the controller 104 as needed.

TABLE

| Oval Minor Axis (Inches) | Initial Round Diameter (Inches) | Oval Major Axis (Inches) | Stroke (Inches) | Spacer (Inches) |
|---|---|---|---|---|
| 8 | 22 | 30.2 | 3.23 | 0 |
| 8 | 24 | 33.4 | 6.40 | 0 |
| 8 | 26 | 36.6 | 5.94 | 4 |
| 8 | 28 | 39.7 | 5.22 | 8 |
| 8 | 30 | 42.9 | 4.39 | 12 |
| 8 | 32 | 46.1 | 7.55 | 12 |
| 8 | 34 | 49.2 | 6.71 | 16 |
| 8 | 36 | 52.4 | 5.82 | 20 |
| 8 | 38 | 55.5 | 5.35 | 4 + 20 |
| 8 | 40 | 58.7 | 4.64 | 8 + 20 |
| 8 | 42 | 61.9 | 3.81 | 12 + 20 |
| 8 | 44 | 65.0 | 6.97 | 12 + 20 |
| 8 | 46 | 68.2 | 6.13 | 16 + 20 |
| 8 | 48 | 71.4 | 5.67 | 4 + 16 + 20 |
| 8 | 50 | 74.5 | 4.96 | 8 + 16 + 20 |
| 8 | 52 | 77.7 | 4.12 | 12 + 16 + 20 |
| 8 | 54 | 80.9 | 7.29 | 12 + 16 + 20 |
| 10 | 24 | 32.3 | 3.26 | 0 |
| 10 | 26 | 35.4 | 6.42 | 0 |
| 10 | 28 | 38.6 | 5.96 | 4 |
| 10 | 30 | 41.7 | 5.25 | 8 |
| 10 | 32 | 44.9 | 4.41 | 12 |
| 10 | 34 | 48.1 | 7.57 | 12 |
| 10 | 36 | 51.2 | 6.74 | 16 |
| 10 | 38 | 54.4 | 5.84 | 20 |
| 10 | 40 | 57.6 | 5.38 | 4 + 20 |
| 10 | 42 | 60.7 | 4.66 | 8 + 20 |
| 10 | 44 | 63.9 | 3.83 | 12 + 20 |
| 10 | 46 | 67.1 | 6.99 | 12 + 20 |
| 10 | 48 | 70.2 | 4.16 | 16 + 20 |
| 10 | 50 | 73.4 | 5.69 | 4 + 16 + 20 |
| 10 | 52 | 76.5 | 4.98 | 8 + 16 + 20 |
| 10 | 54 | 79.7 | 4.15 | 12 + 16 + 20 |
| 10 | 56 | 82.9 | 7.31 | 12 + 16 + 20 |
| 12 | 26 | 34.3 | 3.28 | 0 |
| 12 | 28 | 37.4 | 6.44 | 0 |
| 12 | 30 | 40.6 | 5.98 | 4 |
| 12 | 32 | 43.8 | 5.27 | 8 |
| 12 | 34 | 46.9 | 4.43 | 12 |
| 12 | 36 | 50.1 | 7.59 | 12 |
| 12 | 38 | 53.3 | 6.76 | 16 |
| 12 | 40 | 56.4 | 5.86 | 20 |
| 12 | 42 | 59.6 | 5.40 | 4 + 20 |
| 12 | 44 | 62.7 | 4.69 | 8 + 20 |
| 12 | 46 | 65.9 | 3.85 | 12 + 20 |
| 12 | 48 | 69.1 | 7.01 | 12 + 20 |
| 12 | 50 | 72.2 | 6.18 | 16 + 20 |
| 12 | 52 | 75.4 | 5.72 | 4 + 16 + 20 |

TABLE-continued

| Oval Minor Axis (Inches) | Initial Round Diameter (Inches) | Oval Major Axis (Inches) | Stroke (Inches) | Spacer (Inches) |
|---|---|---|---|---|
| 12 | 54 | 78.6 | 5.00 | 8 + 16 + 20 |
| 12 | 56 | 81.7 | 4.17 | 12 + 16 + 20 |
| 12 | 58 | 84.9 | 7.33 | 12 + 16 + 20 |
| 14 | 28 | 36.3 | 3.30 | 0 |
| 14 | 30 | 39.5 | 6.46 | 0 |
| 14 | 32 | 42.6 | 6.00 | 4 |
| 14 | 34 | 45.8 | 5.29 | 8 |
| 14 | 36 | 49.0 | 4.45 | 12 |
| 14 | 38 | 52.1 | 7.62 | 12 |
| 14 | 40 | 55.3 | 6.78 | 16 |
| 14 | 42 | 58.4 | 5.88 | 20 |
| 14 | 44 | 61.6 | 5.42 | 4 + 20 |
| 14 | 46 | 64.8 | 4.71 | 8 + 20 |
| 14 | 48 | 67.9 | 3.87 | 12 + 20 |
| 14 | 50 | 71.1 | 7.04 | 12 + 20 |
| 14 | 52 | 74.3 | 6.20 | 16 + 20 |
| 14 | 54 | 77.4 | 5.74 | 4 + 16 + 20 |
| 14 | 56 | 80.6 | 5.03 | 8 + 16 + 20 |
| 14 | 58 | 83.8 | 4.19 | 12 + 16 + 20 |
| 14 | 60 | 86.9 | 7.35 | 12 + 16 + 20 |
| 16 | 30 | 38.3 | 3.32 | 0 |
| 16 | 32 | 41.5 | 6.48 | 0 |
| 16 | 34 | 44.6 | 6.02 | 4 |
| 16 | 36 | 47.8 | 5.31 | 8 |
| 16 | 38 | 51.0 | 4.48 | 12 |
| 16 | 40 | 54.1 | 7.64 | 12 |
| 16 | 42 | 57.3 | 6.80 | 16 |
| 16 | 44 | 60.5 | 5.90 | 20 |
| 16 | 46 | 63.6 | 5.44 | 4 + 20 |
| 16 | 48 | 66.8 | 4.73 | 8 + 20 |
| 16 | 50 | 70.0 | 3.89 | 12 + 20 |
| 16 | 52 | 73.1 | 7.06 | 12 + 20 |
| 16 | 54 | 76.3 | 6.22 | 16 + 20 |
| 16 | 56 | 79.4 | 5.76 | 4 + 16 + 20 |
| 16 | 58 | 82.6 | 5.05 | 8 + 16 + 20 |
| 16 | 60 | 85.8 | 4.21 | 12 + 16 + 20 |
| 18 | 32 | 40.3 | 3.34 | 0 |
| 18 | 34 | 43.5 | 6.51 | 0 |
| 18 | 36 | 46.7 | 6.05 | 4 |
| 18 | 38 | 49.8 | 5.33 | 8 |
| 18 | 40 | 53.0 | 4.50 | 12 |
| 18 | 42 | 56.2 | 7.66 | 12 |
| 18 | 44 | 59.3 | 6.82 | 16 |
| 18 | 46 | 62.5 | 5.93 | 20 |
| 18 | 48 | 65.7 | 5.46 | 4 + 20 |
| 18 | 50 | 68.8 | 4.75 | 8 + 20 |
| 18 | 52 | 72.0 | 3.92 | 12 + 20 |
| 18 | 54 | 75.1 | 7.08 | 12 + 20 |
| 18 | 56 | 78.3 | 6.24 | 16 + 20 |
| 18 | 58 | 81.5 | 5.78 | 4 + 16 + 20 |
| 18 | 60 | 84.6 | 5.07 | 8 + 16 + 20 |
| 20 | 34 | 42.4 | 3.36 | 0 |
| 20 | 36 | 45.5 | 6.53 | 0 |
| 20 | 38 | 48.7 | 6.07 | 4 |
| 20 | 40 | 51.9 | 5.36 | 8 |
| 20 | 42 | 55.0 | 4.52 | 12 |
| 20 | 44 | 58.2 | 7.68 | 12 |
| 20 | 46 | 61.3 | 6.85 | 16 |
| 20 | 48 | 64.5 | 5.95 | 20 |
| 20 | 50 | 67.7 | 5.49 | 4 + 20 |
| 20 | 52 | 70.8 | 4.77 | 8 + 20 |
| 20 | 54 | 74.0 | 3.94 | 12 + 20 |
| 20 | 56 | 77.2 | 7.10 | 12 + 20 |
| 20 | 58 | 80.3 | 6.27 | 16 + 20 |
| 20 | 60 | 83.5 | 5.80 | 4 + 16 + 20 |
| 22 | 36 | 44.4 | 3.39 | 0 |
| 22 | 38 | 47.6 | 6.55 | 0 |
| 22 | 40 | 50.7 | 6.09 | 4 |
| 22 | 42 | 53.9 | 5.38 | 8 |
| 22 | 44 | 57.0 | 4.54 | 12 |
| 22 | 46 | 60.2 | 7.70 | 12 |
| 22 | 48 | 63.4 | 6.87 | 16 |
| 22 | 50 | 66.5 | 5.97 | 20 |
| 22 | 52 | 69.7 | 5.51 | 4 + 20 |

TABLE-continued

| Oval Minor Axis (Inches) | Initial Round Diameter (Inches) | Oval Major Axis (Inches) | Stroke (Inches) | Spacer (Inches) |
|---|---|---|---|---|
| 22 | 54 | 72.9 | 4.80 | 8 + 20 |
| 22 | 56 | 76.0 | 3.96 | 12 + 20 |
| 22 | 58 | 79.2 | 7.12 | 12 + 20 |
| 22 | 60 | 82.3 | 6.29 | 16 + 20 |
| 24 | 38 | 46.4 | 3.41 | 0 |
| 24 | 40 | 49.6 | 6.57 | 0 |
| 24 | 42 | 52.7 | 6.11 | 4 |
| 24 | 44 | 55.9 | 5.40 | 8 |
| 24 | 46 | 59.1 | 4.56 | 12 |
| 24 | 48 | 62.2 | 7.73 | 12 |
| 24 | 50 | 65.4 | 6.89 | 16 |
| 24 | 52 | 68.6 | 5.99 | 20 |
| 24 | 54 | 71.1 | 5.53 | 4 + 20 |
| 24 | 56 | 74.9 | 4.82 | 8 + 20 |
| 24 | 58 | 78.0 | 3.98 | 12 + 20 |
| 24 | 60 | 81.2 | 7.15 | 12 + 20 |

In the foregoing TABLE, the two columns "Oval Minor Axis" and "Oval Major Axis" are inputs from the operator. The columns "Initial Round Diameter," "Stroke" and "Spacer" are determined outputs. Information which is required to be communicated to the operator is the "Initial Round Diameter" and the "Spacer." The required head size is the same as the "Oval Minor Axis," which the operator already knows. The "Stroke" can be displayed to the operator as a matter of information, but the "Stroke" is not something the operator actually needs to know, because the operation is automatic.

Figure 13:
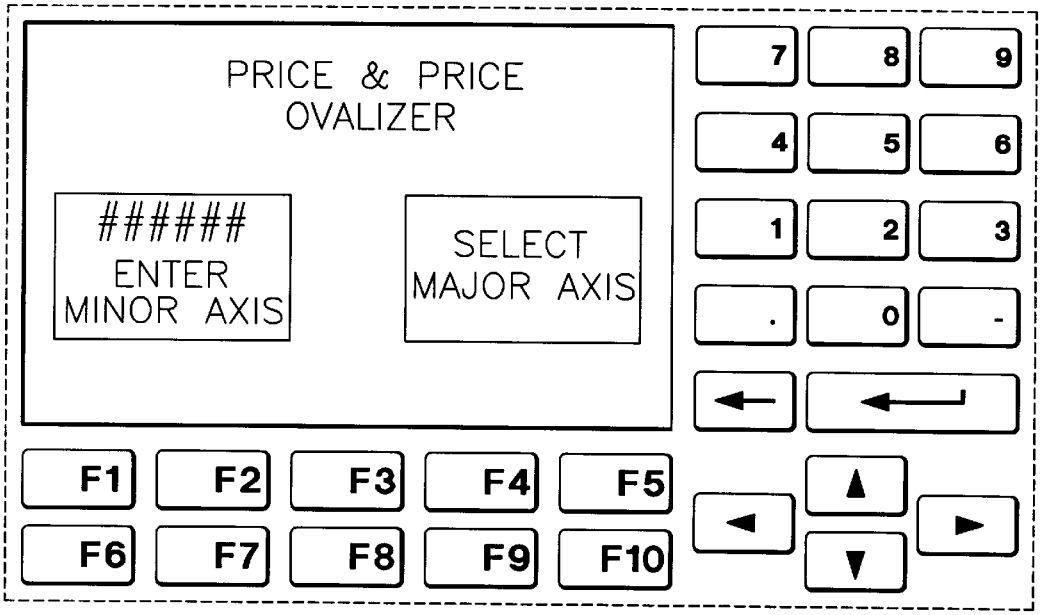
FIG. 13 depicts an initial screen display.

FIG. 13 depicts an initial display presented to the operator via the display screen 112.

The operator first enters the minor axis via the numeric keys, and then touches the "Select Major Axis" display area. The display panel then presents a Major Axis screen (FIG. 14), which displays particular oval major axis dimensions that are available based on the input oval minor axis size. The operator selects the desired major axis.

Figure 15:
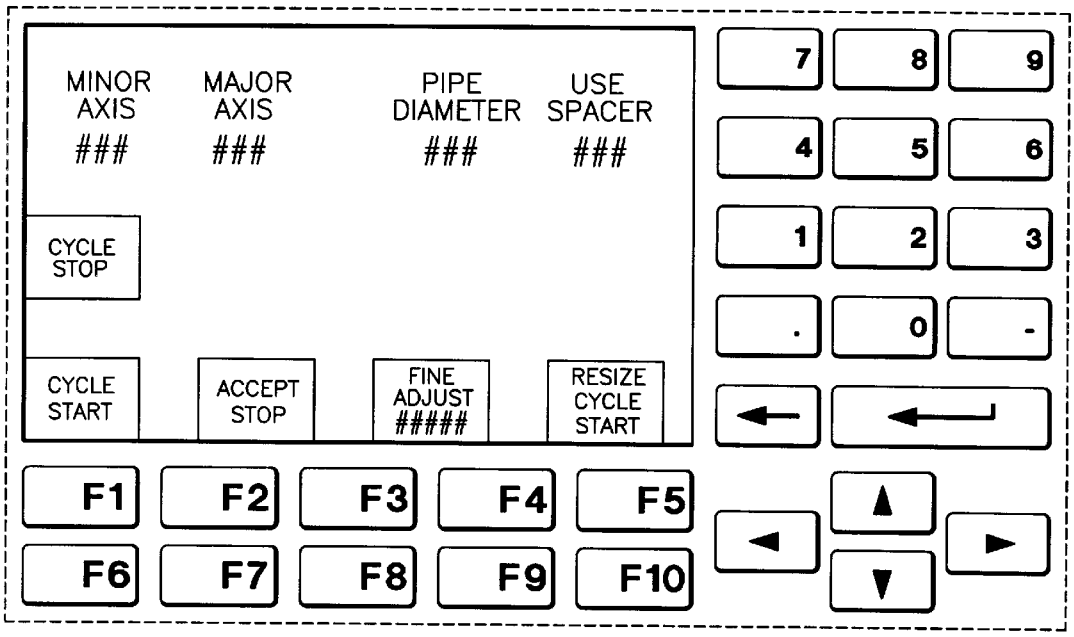
FIG. 15 depicts a cycle control screen display.

The cycle control screen of FIG. 15 is next displayed. As a matter of information, the selected minor axis and major axis are displayed. In addition, the appropriate round ductwork diameter to use, as well as the required spacer size, are displayed.

The operator then loads the round ductwork on to the duct forming members 26 and 28, and then presses the "Cycle Start" button. The machine then automatically ovalizes to the target dimension.

The operator checks the formed duct, and either accepts, which ends the cycle, or enters fine adjust increments, and presses the "Resize Cycle Start" button.

When the operator is satisfied, the operator selects "Cycle Stop," and the duct forming members 26 and 28 retract.

Figure 16:
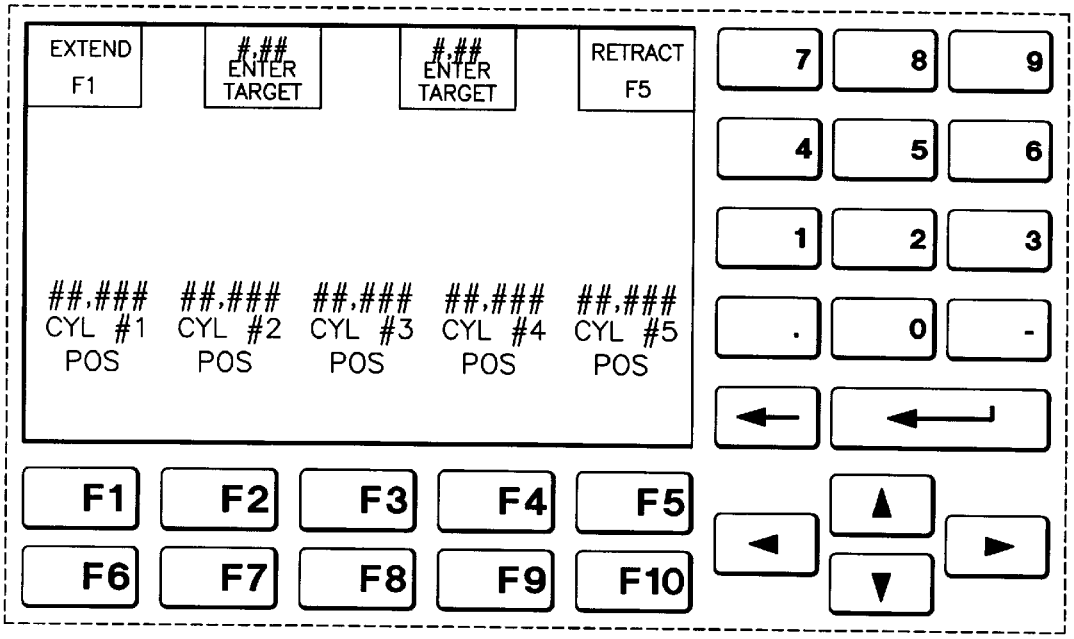
FIG. 16 depicts a screen display for manual control functions.

FIG. 16 depicts an additional available control screen, whereby manual control functions are entered, and the positions of the individual cylinders are displayed. Manual control mode is useful for maintenance and for duct forming experimentation purposes.

In accordance with the second function of the controller 104, to accomplish uniform motion of all points of the duct forming members 26 and 28, within the predetermined tolerance, the controller 104 is operable, when it is desired to extend the hydraulic assemblies 52, 54, 56, 58 and 60 to force the duct forming members 26 and 28 apart, to activate the control valves 132, 134, 136, 138 and 140 in a manner which directs hydraulic fluid through the conduits 201, 203, 205, 207 and 209 to the hydraulic cylinder assemblies 52, 54, 56, 58 and 60 for extending the hydraulic cylinder assemblies, and in particular the cylinder shafts 72, 74, 76, 78 and 80 thereof. During the extension, the controller 104 is further operable, when the position signal from any one of the linear position transducers 92, 94, 96, 98 and 100 indicates that the corresponding hydraulic cylinder assemblies 52, 54, 56, 58 and 60 has extended to the predetermined extended position to individually de-activate the corresponding control valve 132, 134, 136, 138 and 140 thereby terminating further extension of the particular hydraulic cylinder assembly. During an extension operation, the controller 104 is further operable, when the position signals from the linear position transducers 92, 94, 96, 98 and 100 indicate that any one of the hydraulic cylinder assemblies 52, 54, 56, 58 and 60 has extended to a position which is a predetermined threshold distance, for example, 1/64 inch, beyond the extended position of another one of the hydraulic cylinder assemblies 52, 54, 56, 58 and 60, to individually de-activate the control valve 132, 134, 136, 138 and 140 corresponding to the one hydraulic cylinder assembly until the other hydraulic cylinder assembly extends to the position of the one hydraulic assembly.

Feedback control is thus implemented. By proper adjustment of the flow restrictor valves 211, 213, 215, 217 and 219, relatively uniform motion of the hydraulic cylinder assemblies 52, 54, 56, 58 and 60 is achieved with minimal feedback control operation.

Feedback control is required as well during a retraction operation, again to avoid damage to the structure of the ovalizer, and in particular to the hydraulic cylinder assemblies 52, 54, 56, 58 and 60.

The controller 104 is thus additionally operable, when it is desired to retract the hydraulic assemblies 52, 54, 56, 58 and 60 to force the duct forming members 26 and 28 apart, to activate the control valves 132, 134, 136, 138 and 140 in a manner which directs hydraulic fluid through the conduits 202, 204, 206, 208 and 210 to the hydraulic cylinder assemblies 52, 54, 56, 58 and 60 for retracting the hydraulic cylinder assemblies, and in particular the cylinder shafts 72, 74, 76, 78 and 80 thereof. During the retraction, the controller 104 is further operable, when the position signal from any one of the linear position transducers 92, 94, 96, 98 and 100 indicates that the corresponding hydraulic cylinder assemblies 52, 54, 56, 58 and 60 has retracted to a predetermined retracted position to individually de-activate the corresponding control valve 132, 134, 136, 138 and 140 thereby terminating further retraction of the particular hydraulic cylinder assembly. During a retraction operation, the controller 104 is further operable, when the position signals from the linear position transducers 92, 94, 96, 98 and 100 indicate that any one of the hydraulic cylinder assemblies 52, 54, 56, 58 and 60 has retracted to a position which is a predetermined threshold distance, for example, 1/64 inch, beyond the retracted position of another one of the hydraulic cylinder assemblies 52, 54, 56, 58 and 60, to individually de-activate the control valve 132, 134, 136, 138 and 140 corresponding to the one hydraulic cylinder assembly until the other hydraulic cylinder assembly retracts to the position of the one hydraulic assembly.

Referring finally to FIGS. 17A, 17B and 17C, shown is a generalized program flow chart for the controller 104, which effects the above-summarized operation. It will be appreciated that the flow chart of FIGS. 17A, 17B and 17C is generalized, and that the specific programming employs conventional real-time controller programming techniques.

Execution begins at 500. In step 502, the operator inputs the desired oval ductwork size, as described above with reference to FIGS. 13 and 14.

Next, in step 504, the controller determines the round duct diameter, the required stroke, and the spacer size. Typically, this is done by reference to a simple look up table, incorporating the information presented in the TABLE hereinabove. However, it will be appreciated that other techniques may be employed to suit the circumstances, such as calculating the required values based on formulas.

Next, in step 506, at least the required round duct diameter and the spacer size are displayed to the operator, as described hereinabove with reference to FIG. 15.

Decision step 508 is a simple "wait" loop, in which program execution waits for the operator to press the "cycle start" button of FIG. 15.

When the operator selects "cycle start," execution proceeds to step 510, in which the controller 104 sends appropriate signals to the directional control valves 132, 134, 136, 138 and 140 to open the valves in a manner which applies hydraulic fluid along lines 201, 203, 205, 207 and 209 for cylinder extension.

As the cylinders extend, a loop involving flow chart boxes 512, 514, 516, 518 and 520 is executed, until all cylinders 652, 654, 656, 658 and 660 have extended the required stroke.

More particularly, flow chart box 512 is a decision box which asks, employing signals from the linear position transducers 82, 84, 86, 88 and 90, whether all of the cylinders have remained within the predetermined threshold distance of each other. If the answer is "no," then in box 504 the individual valve corresponding to the cylinder which has extended beyond the others is closed, until that individual cylinder catches up, whereupon the valve is reopened.

If the answer in decision box 512 is "yes," then in decision box 516, the question is asked, again with reference to signals from the linear position transducers 82, 84, 86, 88 and 90, whether any cylinder has extended the required stroke. If the answer is "no," then execution loops back to decision box 512. If the decision in box 516 is "yes," then execution proceeds to box 518, where the individual control valve for the cylinder which has extended the required stroke distance is closed, and remains closed.

Then, decision box 512 is executed, which asks whether all cylinders have extended the required stroke. If the answer is "no," then execution again loops back to decision box 512.

When all cylinders have extended the required stroke, the answer in decision box 520 is "yes," and another late loop, box 522 is entered, waiting for the operator to press the "cycle stop" button of FIG. 15.

At that point, the cylinders are retracted. In particular, in decision box 534, the valves are all open in the direction for cylinder retraction, the opposite direction as in box 510.

Execution then enters a loop including boxes 526, 528, 530, 532 and 534, which correspond respectively to boxes 512, 514, 516, 518 and 520, functioning in the same way, except that the cylinders are retracting.

When decision box 534 determines that all cylinders have returned to the home position, program execution ends at 536.

Figure 14:
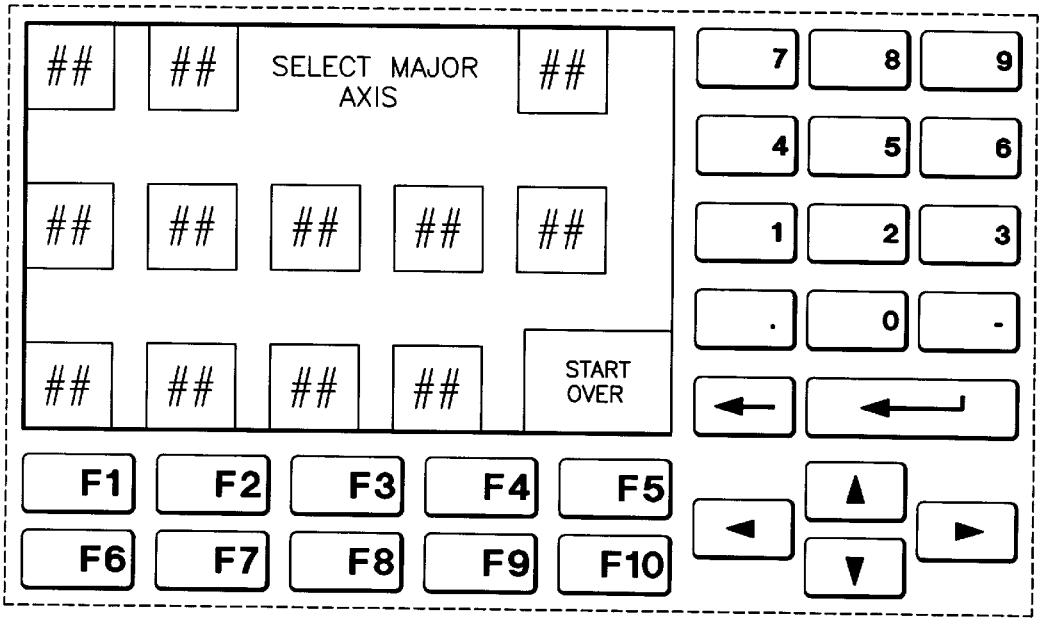
FIG. 14 depicts a major axis screen display.

It will be appreciated that the additional control functions described hereinabove with reference to FIGS. 13, 14 and 15, as well as the manual control functions described hereinabove with reference to FIG. 16, are readily implemented in employing conventional programming techniques.

While specific embodiments of the invention have been illustrated and described herein, it is realized that numerous modifications and changes will occur to those skilled in the art. It is therefore to be understood that the appendant claims are intended to cover all such modifications and changes that fall within the true spirit and scope of the invention.

What is claimed is:

1. Apparatus for forming round ductwork to oval, comprising:

a pair of elongated and laterally spaced-apart duct forming members sized to fit within a ductwork section and to bear against opposing interior surfaces thereof;

a plurality of hydraulic cylinder assemblies spaced longitudinally along and between said duct forming members for forcing said duct forming members apart;

a plurality of signal-controlled valves, each of said valves connected for controlling the application of hydraulic fluid under pressure to a corresponding one of said hydraulic cylinder assemblies; and a feedback control system including a plurality of position transducers connected to corresponding ones of said hydraulic cylinder assemblies and outputting position signals indicating the extension of each hydraulic cylinder assembly, and including a controller connected to said position transducers for receiving the position signals and connected to said valves for controlling said valves, said controller operable, when it is desired to extend said hydraulic cylinder assemblies to force said duct forming members apart, to control said valves while monitoring the outputs of said position transducers such that said hydraulic cylinder assemblies extend together at approximately the same rate and stop when a predetermined position is reached.

2. The apparatus of claim 1, wherein said hydraulic cylinder assemblies are resiliently mounted to at least one of said duct forming members to accommodate differences in the extensions of individual ones of said hydraulic cylinder assemblies without damage to said apparatus.

3. The apparatus of claim 1, wherein each of said duct forming members comprises a structural beam and a semi-cylindrical head that can be repeatedly installed on and removed from said structural beam.

4. The apparatus of claim 3, which comprises a set of semi-cylindrical heads of different diameters corresponding to the minor axes of different sizes of oval ductwork after forming for selective installation on said structural beams.

5. The apparatus of claim 4, which further comprises a set of spacers that can be installed between the structural beam and semi-cylindrical head of one of said duct forming members.

6. The apparatus of claim 3, which further comprises a set of spacers that can be installed between the structural beam and semi-cylindrical head of one of said duct forming members.

7. The apparatus of claim 1, which further comprises:

an operator input device connected to said controller; and wherein said controller is further operable, via said operator input device, to accept an input from an operator of said apparatus specifying a desired oval ductwork size and to determine a hydraulic cylinder assembly stroke to effect forming of the section of round ductwork to oval ductwork of the specified desired size.

8. The apparatus of claim 7, which further comprises:

a display device connected to said controller; and wherein said controller is further operable, via said operator input device and said display device, to accept an input from an operator of said apparatus specifying a desired oval ductwork size, to determine a round ductwork size, a hydraulic cylinder assembly stroke, a spacer size, if any, and to output to the operator at least the determined round ductwork size and the determined spacer size, if any.

9. Apparatus for forming round ductwork to oval, comprising:

a pair of elongated and laterally spaced-apart duct forming members sized to fit within a ductwork section and to bear against opposing interior surfaces thereof;

a plurality of hydraulic cylinder assemblies spaced longitudinally along and between said duct forming members for forcing said duct forming members apart;

a plurality of position transducers, each of said position transducers connected to a corresponding one of said hydraulic cylinder assemblies and outputting a position signal indicating the extension of said corresponding hydraulic cylinder assembly;

a plurality of signal-activated control valves, each of said control valves connected for selectively directing hydraulic fluid under pressure to a corresponding one of said hydraulic cylinder assembles; and a controller connected to said position transducers for receiving the position signals and connected to said control valves for activating said control valves, said controller operable, when it is desired to extend said hydraulic cylinder assemblies to force said duct forming members apart, to activate said control valves, and further operable, when the position signal from any one of said position transducers indicates that the corresponding hydraulic cylinder assembly has extended to a predetermined position, to individually de-activate the corresponding control valve.

10. The apparatus of claim 9, wherein said controller is further operable, when the position signals from said position transducers indicate that any one of the hydraulic cylinder assemblies has extended to a position which is a predetermined threshold distance beyond the position of another one of the hydraulic cylinder assemblies, to individually de-activate the control valve corresponding to the one hydraulic cylinder assembly until the other hydraulic cylinder assembly extends to the position of the one hydraulic cylinder assembly.

11. The apparatus of claim 10, wherein the predetermined threshold distance is less than 1/64 inch.

12. The apparatus of claim 10, which further comprises a plurality of adjustable flow restrictors connected for individually restricting the rate of flow of hydraulic fluid to said hydraulic cylinder assemblies, whereby said apparatus can be adjusted so that said hydraulic cylinder assemblies extend at approximately the same rate when all of said control valves are activated.

13. The apparatus of claim 12, wherein said flow restrictors are adjusted so that said hydraulic cylinder assemblies extend at a rate of approximately ½ inch per second when all of said control valves are activated.

14. The apparatus of claim 10, wherein said hydraulic cylinder assemblies are resiliently mounted to at least one of said duct forming members to accommodate differences in the extensions of individual ones of said hydraulic cylinder assemblies at least as great as the predetermined threshold distance without damage to said apparatus.

15. The apparatus of claim 9, which further comprises a plurality of adjustable flow restrictors connected for individually restricting the rate of flow of hydraulic fluid to said hydraulic cylinder assemblies, whereby said apparatus can be adjusted so that said hydraulic cylinder assemblies extend at approximately the same rate when all of said control valves are activated.

16. The apparatus of claim 15, wherein said flow restrictors are adjusted so that said hydraulic cylinder assemblies extend at a rate of approximately ½ inch per second when all of said control valves are activated.

17. The apparatus of claim 9, wherein said hydraulic cylinder assemblies are resiliently mounted to at least one of said duct forming members to accommodate differences in the extensions of individual ones of said hydraulic cylinder assemblies without damage to said apparatus.

18. Apparatus for forming round ductwork to oval, comprising:

a pair of elongated and laterally spaced-apart duct forming members sized to fit within a ductwork section and to bear against opposing interior surfaces thereof;

a plurality of double-acting hydraulic cylinder assemblies spaced longitudinally along and between said duct forming members for selectively moving said duct forming members apart for duct forming and towards each other for member retraction;

a plurality of signal-controlled valves, each of said valves connected for controlling the application of hydraulic fluid under pressure to a corresponding one of said hydraulic cylinder assemblies for selectively causing said corresponding hydraulic cylinder assembly to extend and to retract; and a feedback control system including a plurality of position transducers connected to corresponding ones of said hydraulic cylinder assemblies and outputting position signals indicating the position of each hydraulic cylinder assembly, and including a controller connected to said position transducers for receiving the position signals and connected to said valves for controlling said valves, said controller operable, when it is desired to extend said hydraulic cylinder assemblies to force said duct forming members apart, to control said valves while monitoring the outputs of said position transducers such that said hydraulic cylinder assemblies extend together at approximately the same rate and stop when a predetermined extended position is reached, and said controller operable, when it is desired to retract said hydraulic cylinder assemblies to retract said duct forming members, to control said valves while monitoring the outputs of said position transducers such that said hydraulic cylinder assemblies retract together at approximately the same rate and stop when a predetermined retracted position is reached.

19. The apparatus of claim 18, wherein said hydraulic cylinder assemblies are resiliently mounted to at least one of said duct forming members to accommodate differences in the extensions and retractions of individual ones of said hydraulic cylinder assemblies without damage to said apparatus.

20. The apparatus of claim 18, wherein each of said duct forming members comprises a structural beam and a semi-cylindrical head that can be repeatedly installed on and removed from said structural beam.

21. The apparatus of claim 20, which comprises a set of semi-cylindrical heads of different diameters corresponding to the minor axes of different sizes of oval ductwork after forming for selective installation on said structural beams.

22. The apparatus of claim 21, which further comprises a set of spacers that can be installed between the structural beam and semi-cylindrical head of one of said duct forming members.

23. The apparatus of claim 20, which further comprises a set of spacers that can be installed between the structural beam and semi-cylindrical head of one of said duct forming members.

24. The apparatus of claim 18, which further comprises:

an operator input device connected to said controller; and wherein said controller is further operable, via said operator input device, to accept an input from an operator of said apparatus specifying a desired oval ductwork size and to determine a hydraulic cylinder assembly stroke to effect forming of the section of round ductwork to oval ductwork of the specified desired size.

25. The apparatus of claim 24, which further comprises:

a display device connected to said controller, and wherein said controller is further operable, via said operator input device and said display device, to accept an input from an operator of said apparatus specifying a desired oval ductwork size, to determine a round ductwork size, a hydraulic cylinder assembly stroke, a spacer size, if any, and to output to the operator at least the determined round ductwork size and the determined spacer size, if any.

26. Apparatus for forming round ductwork to oval, comprising:

a pair of elongated and laterally spaced-apart duct forming members sized to fit within a ductwork section and to bear against opposing interior surfaces thereof;

a plurality of double-acting hydraulic cylinder assemblies spaced longitudinally along and between said duct forming members for selectively moving said duct forming members apart for duct forming and towards each other for member retraction;

a plurality of position transducers, each of said position transducers connected to a corresponding one of said hydraulic cylinder assemblies and outputting a position signal indicating the position of said corresponding hydraulic cylinder assembly;

a plurality of signal-activated control valves, each of said control valves connected for selectively directing hydraulic fluid under pressure to a corresponding one of said hydraulic cylinder assemblies for selectively causing said corresponding hydraulic cylinder assembly to extend and to retract;

a controller connected to said position transducers for receiving the position signals and connected to said control valves for activating said control valves;

said controller operable, when it is desired to extend said hydraulic cylinder assemblies to force said duct forming members apart, to activate said control valves in a manner which directs hydraulic fluid to said hydraulic cylinder assemblies for extending said hydraulic cylinder assemblies, and further operable, when the position signal from any one of said position transducers indicates that the corresponding hydraulic cylinder assembly has extended to a predetermined extended position, to individually de-activate the corresponding control valve; and said controller operable, when it is desired to retract said hydraulic cylinder assemblies to retract said duct forming members, to activate said control valves in a manner which directs hydraulic fluid to said hydraulic cylinder assemblies for retracting said hydraulic cylinder assemblies, and further operable, when the position signal from any one of said position transducers indicates that the corresponding hydraulic cylinder assembly has retracted to a predetermined retraced position, to individually de-activate the corresponding control valve.

27. The apparatus of claim 26, wherein:

said controller is further operable, when it is desired to extend said hydraulic cylinder assemblies and when the position signals from said position transducers indicate that any one of the hydraulic cylinder assemblies has extended to a position which is a predetermined threshold distance beyond the extended position of another one of the hydraulic cylinder assemblies, to individually de-activate the control valve corresponding to the one hydraulic cylinder assembly until the other hydraulic cylinder assembly extends to the position of the one hydraulic cylinder assembly; and said controller is further operable, when it is desired to retract said duct forming members and when the position signals from said position transducers indicate that any one of said hydraulic cylinder assemblies has retracted to a position which is the predetermined threshold distance beyond the retracted position of another one of the hydraulic cylinder assemblies, to individually de-activate the control valve corresponding to the one hydraulic cylinder assembly until the other hydraulic cylinder assembly retracts to the position of the one hydraulic cylinder assembly.

28. The apparatus of claim 27, wherein the predetermined threshold distance is less than 1/64 inch.

29. The apparatus of claim 27, which further comprises a plurality of adjustable flow restrictors connected for individually restricting the rate of flow of hydraulic fluid to said hydraulic cylinder assemblies for extending and retracting said hydraulic cylinder assemblies, whereby said apparatus can be adjusted so that, when all of said control valves are activated in a manner which directs hydraulic fluid to said hydraulic cylinder assemblies for extending said hydraulic cylinder assemblies, said hydraulic cylinder assemblies extend at approximately the same rate, and, when all of said control valves are activated in a manner which directs hydraulic fluid to said hydraulic cylinder assemblies for retracting said hydraulic cylinder assemblies, said hydraulic cylinder assemblies retract at approximately the same rate.

30. The apparatus of claim 29, wherein said flow restrictors are adjusted so that, when all of said control valves are activated in a manner which directs hydraulic fluid to said hydraulic cylinder assemblies for extending said hydraulic cylinder assemblies, said hydraulic cylinder assemblies extend at a rate of approximately ½ inch per second, and, when all of said control valves are activated in a manner which directs hydraulic fluid to said hydraulic cylinder assemblies for retracting said hydraulic cylinder assemblies, said hydraulic cylinder assemblies retract at a rate of approximately ½ inch per second.

31. The apparatus of claim 27, wherein said hydraulic cylinder assemblies are resiliently mounted to at least one of said duct forming members to accommodate differences in the extensions and retractions of individual ones of said hydraulic cylinder assemblies at least as great as the predetermined threshold distance without damage to said apparatus.

32. The apparatus of claim 26, which further comprises a plurality of adjustable flow restrictors connected for individually restricting the rate of flow of hydraulic fluid to said hydraulic cylinder assemblies for extending and retracting said hydraulic cylinder assemblies, whereby said apparatus can be adjusted so that, when all of said control valves are activated in a manner which directs hydraulic fluid to said hydraulic cylinder assemblies for extending said hydraulic cylinder assemblies, said hydraulic cylinder assemblies extend at approximately the same rate, and, when all of said control valves are activated in a manner which directs hydraulic fluid to said hydraulic cylinder assemblies for retracting said hydraulic cylinder assemblies, said hydraulic cylinder assemblies retract at approximately the same rate.

33. The apparatus of claim 32, wherein said flow restrictors are adjusted so that, when all of said control valves are activated in a manner which directs hydraulic fluid to said hydraulic cylinder assemblies for extending said hydraulic cylinder assemblies, said hydraulic cylinder assemblies extend at a rate of approximately ½ inch per second, and, when all of said control valves are activated in a manner which directs hydraulic fluid to said hydraulic cylinder assemblies for retracting said hydraulic cylinder assemblies, said hydraulic cylinder assemblies retract at a rate of approximately ½ inch per second.

34. The apparatus of claim 26, wherein said hydraulic cylinder assemblies are resiliently mounted to at least one of said duct forming members to accommodate differences in the extensions and retractions of individual ones of said hydraulic cylinder assemblies without damage to said apparatus.

* * * * *